US009946191B2

(12) United States Patent
Matsumoto et al.

(10) Patent No.: US 9,946,191 B2
(45) Date of Patent: Apr. 17, 2018

(54) IMAGE FORMING APPARATUS

(71) Applicant: CANON KABUSHIKI KAISHA, Tokyo (JP)

(72) Inventors: Atsushi Matsumoto, Toride (JP); Kyosuke Takahashi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/354,020

(22) Filed: Nov. 17, 2016

(65) Prior Publication Data

US 2017/0068183 A1 Mar. 9, 2017

Related U.S. Application Data

(60) Provisional application No. PCT/JP2015/065489, filed on May 22, 2015.

(30) Foreign Application Priority Data

May 23, 2014 (JP) ..... 2014-107572

(51) Int. Cl.
*G03G 15/08* (2006.01)

(52) U.S. Cl.
CPC ..... *G03G 15/0865* (2013.01); *G03G 15/0893* (2013.01); *G03G 2215/0833* (2013.01); *G03G 2215/0838* (2013.01)

(58) Field of Classification Search
CPC ..... G03G 15/0865; G03G 15/0893; G03G 2215/0838; G03G 2215/0833
USPC ..... 399/53
See application file for complete search history.

(56) References Cited

U.S. PATENT DOCUMENTS 8,045,900 B2 10/2011 Kubo et al.
8,374,528 B2 2/2013 Kubo et al.
(Continued)

FOREIGN PATENT DOCUMENTS

JP H02-021591 B2 5/1990
JP 04204776 A * 7/1992
(Continued)

OTHER PUBLICATIONS

Atsushi Matsumoto et al., U.S. Appl. No. 15/353,812, filed Nov. 17, 2016.
(Continued)

*Primary Examiner* — Billy Lactaoen
(74) *Attorney, Agent, or Firm* — Fitzpatrick, Cella, Harper & Scinto

(57) ABSTRACT

An image forming apparatus that continuously carries out image formation on a plurality of recording materials includes an image bearing member and a developing device configured to develop an electrostatic latent image on the image bearing member. A first feeding screw is provided in a developing chamber and includes a first screw portion, a second screw portion and a third screw portion. Each of the second and third screw portions are provided with a blade portion formed helically on an outer peripheral surface of a rotation shaft of the first feeding screw, and the first screw portion is not provided with the blade portion. Based on information on the relative humidity in the developing container and on the amount of toner consumed with the image formation on a plurality of recording materials, a controller controls a driving speed for rotationally driving the first feeding screw by a driving device.

18 Claims, 21 Drawing Sheets

(56) References Cited

U.S. PATENT DOCUMENTS

| | | | | |
|---|---|---|---|---|
| 8,385,754 | B2 | 2/2013 | Hirobe et al. | |
| 9,250,570 | B2 | 2/2016 | Matsumoto | |
| 9,442,425 | B2 | 9/2016 | Matsumoto | |
| 2008/0240757 | A1* | 10/2008 | Suzuki | G03G 15/0808 399/53 |
| 2009/0245832 | A1 | 10/2009 | Aoki et al. | |
| 2011/0064435 | A1 | 3/2011 | Takahashi et al. | |
| 2012/0269555 | A1 | 10/2012 | Matsumoto et al. | |

FOREIGN PATENT DOCUMENTS

| | | | |
|---|---|---|---|
| JP | H04-204776 | A | 7/1992 |
| JP | 2000-112238 | A | 4/2000 |
| JP | 2002-365911 | A | 12/2002 |
| JP | 2003-107904 | A | 4/2003 |
| JP | 2003-167480 | A | 6/2003 |
| JP | 2008-275705 | A | 11/2008 |
| JP | 2009-58649 | A | 3/2009 |
| JP | 2009-092911 | A | 4/2009 |
| JP | 2009-244455 | A | 10/2009 |
| JP | 2010-204171 | A | 9/2010 |
| JP | 2011-048117 | A | 3/2011 |
| JP | 2012-27248 | A | 2/2012 |
| JP | 2012-234153 | A | 11/2012 |

OTHER PUBLICATIONS

PCT International Search Report and the Written Opinion dated Aug. 4, 2015, in PCT/JP2015/489.

* cited by examiner

IMAGE FORMING APPARATUS

This application is a continuation of PCT Application No. PCT/JP2015/065489, filed on May 22, 2015.

TECHNICAL FIELD

The present invention relates to an image forming apparatus such as a copying machine, a printer, a facsimile machine, a multi-function machine having a plurality of functions of these machines, and the like.

BACKGROUND ART

In general, in an image forming apparatus of an electrophotographic type, an electrostatic latent image formed on a photosensitive drum as an image bearing member is developed as a toner image with a developer containing a toner and a carrier by a developing device as a developing means. In such a developing device, in a circulating path in a developing container, the toner and the carrier are triboelectrically charged by feeding the developer while stirring the developer by rotating a feeding screw. The developer containing the toner and the carrier gradually lowers in charging performance of the carrier by continuous circulation of the carrier which is not consumed by image formation while being subjected to friction in the developing container. For this reason, ensuring of an average charge performance of the carrier in the developer has been conventionally made by discharging a part of the developer by overflow through a discharge opening provided in the developing container while supplying a new (fresh) developer to the developing container (Japanese Patent Publication Hei 2-21591).

Further, a developing device constituted so that a force, with respect to a circumferential direction or an outward radial direction, acting on the developer by rotation of the feeding screw in an opposing region to a developer discharge opening is made smaller than a force in another region has been proposed (Japanese Laid-Open Patent Application (JP-A) 2000-112238). Specifically, a constitution in which a blade of the feeding screw in the opposing region to the developer discharge opening is made small or a constitution in which the blade is omitted (removed) is employed.

SUMMARY OF THE INVENTION

Problem to be Solved by the Invention

Here, as in the constitution described in JP-A 2000-112238, when the blade of the feeding screw in the opposing region to the discharge opening is removed or made small in diameter, developer feeding power of the feeding screw in this region lowers. Then, in the neighborhood of the discharge opening, the developer fed by the feeding screw stagnates and a developer surface rises, so that the developer which gets over the discharge opening is discharged so as to level off and overflow the discharge opening.

However, in a constitution in which the developer is thus stagnated, when a charge amount of the developer lowers, flowability of the developer becomes high, and therefore a degree of stagnation of the developer in the neighborhood of the discharge opening becomes small, so that the developer is not readily discharged through the discharge opening. As a result of this, the developer in the developing container increases in amount, so that there is an increasing possibility in some cases that the developer overflows the discharge opening during rising or the like of a developing device and that a rotational load of the feeding screw becomes high and the feeding screw locks.

In view of the above-described circumstances, the direction has been accomplished for properly making discharge of the developer in a constitution in which the developer feeding power of the feeding screw in the opposing region to the discharge opening is low.

Means for Solving the Problem

According to an aspect of the present invention, there is provided an image forming apparatus comprising: an image bearing member; a developing device configured to develop a latent image formed on the image bearing member and including a developing container in which a developer is accommodated, a feeding screw configured to feed the developer in the developing container, and a discharge opening provided in a side surface of the developing container so as to oppose the feeding screw and configured to permit discharge of an excessive developer in the developing device; a supplying device configured to supply the developer into the developing container; a driving device configured to rotationally drive the feeding screw; an acquiring portion configured to acquire information on a charge amount of the developer; and a controller configured to control the driving device, wherein the feeding screw is formed so that an outer diameter of a first region including a portion opposing the discharge opening is smaller than an outer diameter of a second region adjacent to the first region, and wherein on the basis of information of the acquiring portion, the controller effects control so that a driving speed at which the feeding screw is driven by the driving device is faster when the charge amount of the developer corresponds to a second charge amount lower than a first charge amount, than when the charge amount of the developer corresponds to the first charge amount.

According to this embodiment, in a state in which the flowability of the developer becomes high and the charge amount is low, control is effected so that a feeding screw driving speed becomes fast (high), and therefore even when the flowability of the developer is high and the developer does not readily stagnate in the neighborhood of the discharge opening, a developer surface is raised and discharge of the developer can be properly performed.

DESCRIPTION OF THE EMBODIMENTS

First Embodiment

Figure 1:
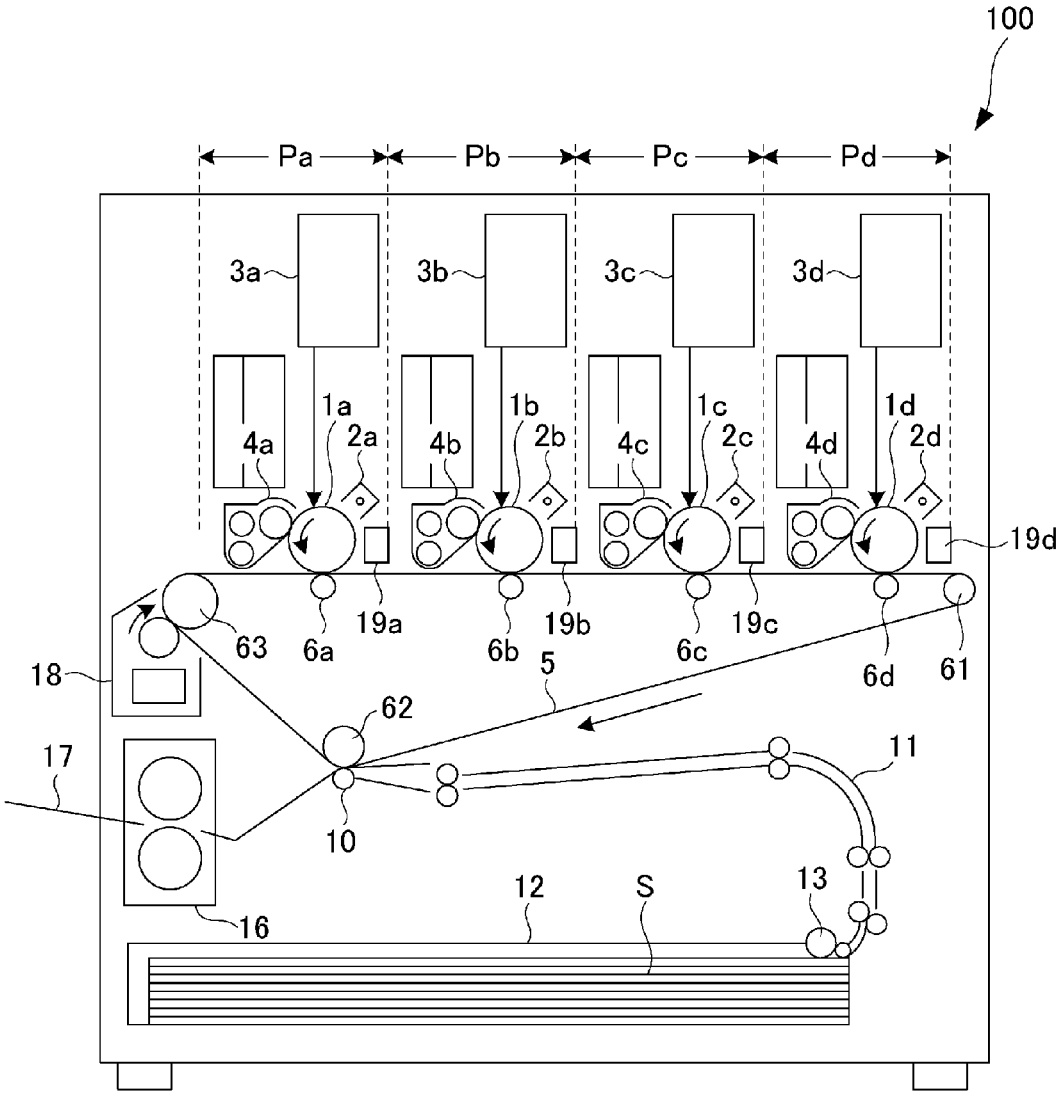
FIG. 1 is a schematic structural view of an image forming apparatus according to a First Embodiment of the present invention.

The First Embodiment of the present invention will be described with reference to FIGS. 1-12. First, a general structure of an image forming apparatus in this embodiment will be described with reference to FIG. 1.

[Image Forming Apparatus]

An image forming apparatus 100 in this embodiment is a full-color image forming apparatus employing an electrophotographic type and includes four image forming portions P (Pa, Pb, Pc, Pd). The respective image forming portions Pa-Pd include drum-shaped electrophotographic photosensitive members, i.e., photosensitive drums 1 (1*a*, 1*b*, 1*c*, 1*d*). At peripheries of the photosensitive drums 1, charging devices 2 (2*a*, 2*b*, 2*c*, 2*d*), developing devices 4 (4*a*, 4*b*, 4*c*, 4*d*), primary transfer rollers 6 (6*a*, 6*b*, 6*c*, 6*d*) and cleaning devices 19 (19*a*, 19*b*, 19*c*, 19*d*) and the like are provided. Further, above the photosensitive drums 1 in FIG. 1, laser beam scanners 3 (3*a*, 3*b*, 3*c*, 3*d*) as exposure means are placed.

The respective image forming portions Pa, Pb, Pc, Pd have the substantially same constitution except that colors of toners are different from each other, and therefore in the following, as long as there is no need particularly, suffixes (a, b, c, d) of reference numerals or symbols showing constituent elements or portions of the associated image forming portions will be omitted from description.

Next, an image forming sequence of an entirety of the image forming apparatus having the above constitution will be described. First, the photosensitive drum 1 is electrically charged uniformly by the charging device 2 as a charging means. The uniformly charged photosensitive drum 1 is then subjected to scanning exposure by the above-described laser beam scanner 3 to laser light modulated by an image signal. The laser beam scanner 3 incorporates therein a semiconductor laser, and this semiconductor laser is controlled correspondingly to an original image information signal outputted from an original reader including a photoelectric conversion element such as a CCD or the like, and emits the laser light.

As a result, a surface potential of the photosensitive drum 1 charged by the charging device 2 changes at an image portion, so that an electrostatic latent image is formed on the photosensitive drum 1. This electrostatic latent image is reversely developed with a toner by the developing device 4 as a developing means into a visible image, i.e., a toner image. In this embodiment, the developing device 4 uses a two-component contact development type in which a developer containing the toner and a carrier is used in mixture as a developer.

Further, the above-described steps are performed every one of the image forming portions Pa, Pb, Pc, Pd, so that four color toner images of yellow, magenta, cyan, black are formed on the photosensitive drums 1*a*, 1*b*, 1*c*, 1*d*, respectively.

In this embodiment at positions under the image forming portions Pa, Pb, Pc, Pd, an intermediary transfer belt 5 which is constituted by an endless belt as an intermediary transfer member is provided. The intermediary transfer belt 5 is stretched by rollers 61, 62, 63 and is movable in an arrow direction.

The toner images on the photosensitive drums 1 are successively transferred once onto the intermediary transfer belt 5 by the primary transfer rollers 6. By this, the four color toner images of yellow, magenta, cyan, black are superposed on the intermediary transfer belt 5, so that a full-color image is formed. Further, the toner remaining on the photosensitive drum 1 without being transferred onto the intermediary transfer belt 5 is collected by a cleaning device 19.

The full-color image on the intermediary transfer belt 5 is transferred by the action of a secondary transfer roller 10 as a secondary transfer means onto a recording material (sheet material) S such as paper or a sheet which is taken out from a cassette 12 and which passed through a feeding roller 13 and a guide 11. The toner remaining on the surface of the intermediary transfer belt 5 without being transferred onto the recording material S is collected by an intermediary transfer belt cleaning device 18.

On the other hand, the recording material S on which the toner image is transferred is sent to a fixing device 16, and the toner image is fixed on the recording material S by being heated and pressed. The recording material S on which the toner image is fixed is discharged onto a discharge tray 17.

Incidentally, in this embodiment, as the image bearing member, the photosensitive drum 1 which is a drum-shaped organic photosensitive member which is ordinarily used was used, but it is also possible to use an inorganic photosensitive member such as an amorphous silicon photosensitive member. Further, it is also possible to use a belt-shaped photosensitive member. Further, also as regards the charging type, the transfer type, the cleaning type and the fixing type, they are not limited to those described above.

[Developing Device]

Figure 2:
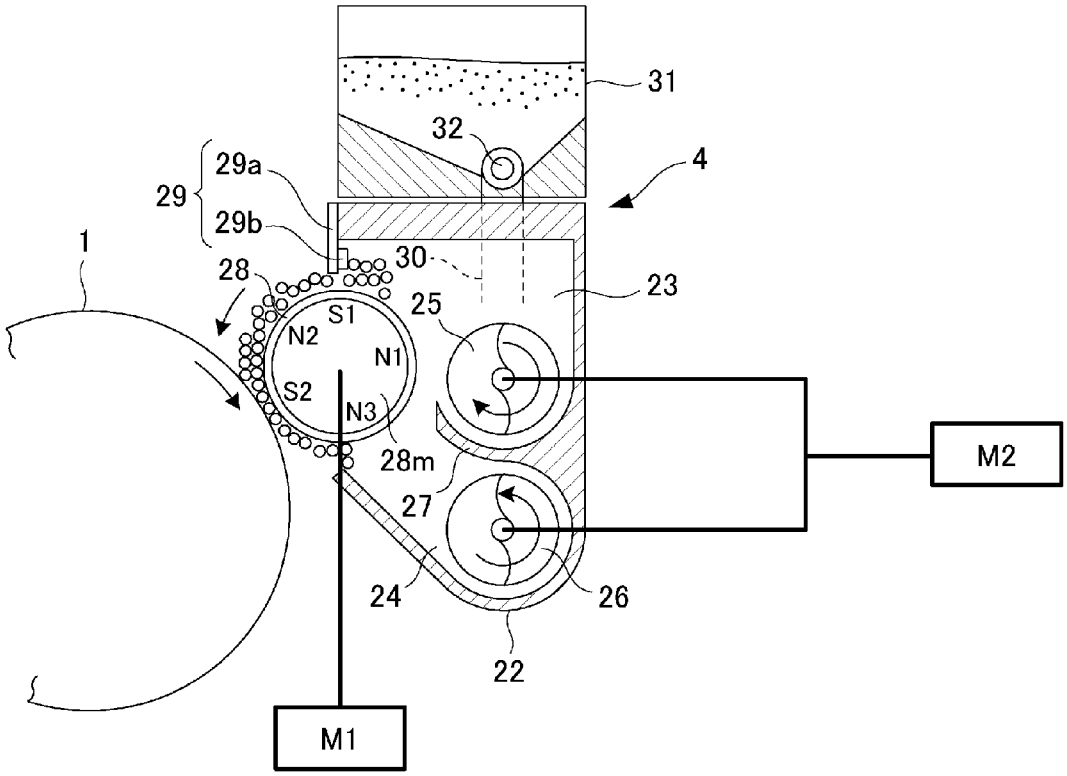
FIG. 2 is a schematic cross-sectional structural view of a developing device according to the First Embodiment.
Figure 3:
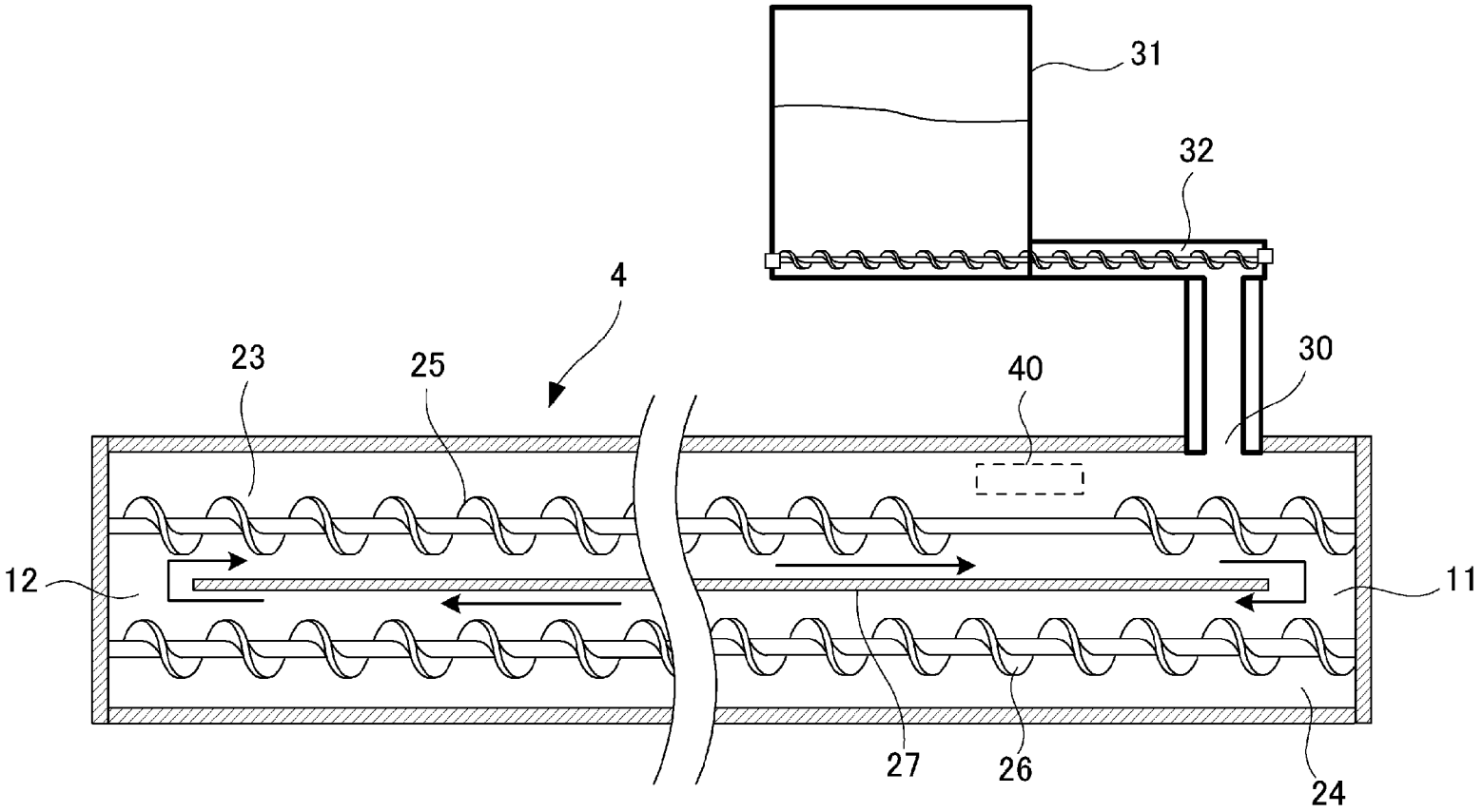
FIG. 3 is a schematic longitudinal structural view of the developing device.

Next, the developing device 4 in this embodiment will be described more specifically using FIGS. 2 and 3. The developing device 4 includes a developing container 22, and a two-component developer containing the toner and the carrier is accommodated as the developer in the developing container 22. In addition, in the developing container 22, a developing sleeve 28 serves as a developer carrying member and a developing blade regulates a chain of the developer carried on the developing sleeve 28. The inside of the developing container 22 is vertically divided by a partition wall 27 into a developing chamber 23 and a stirring chamber 24, and the developer is accommodated, in which a substantially central portion of the partition wall 27 extends in the direction perpendicular to the drawing sheet surface of the figure, and the developer is accommodated in the developing chamber 23 and the stirring chamber 24.

In the developing chamber 23 and the stirring chamber 24, first and second feeding screws 25 and 26 are disposed, respectively, as developer feeding members. The first feeding screw 25 is disposed, at the bottom (portion) of the developing chamber 23, substantially in parallel to an axial direction of the developing sleeve 24. Further, the first feeding screw 25 rotates in an indicated arrow direction (clockwise direction) in the figure, and supplies the developer in the developing chamber 23 to the developing sleeve and feeds the developer in one direction along the axial direction.

Further, the second feeding screw 26 is disposed, at the bottom (portion) of the stirring chamber 24, substantially in parallel to the first feeding screw 25. Further, the second feeding screw 26 rotates in an opposite direction (counterclockwisely) to the rotational direction of the first feeding screw 25 and collects the developer after being subjected to the development, and feeds the developer in the stirring chamber 24 in the direction opposite to that of the first feeding screw 25. Thus, by the feeding of the developer through the rotation of the first and second feeding screws 25 and 26, the developer is circulated between the developing chamber 23 and the stirring member 24 through openings 11 and 12 (that is, communicating portions) formed at both ends of the partition wall 27.

Next, a driving system of the developing device 4 will be described using FIG. 2. The developing sleeve 28 is rotationally driven by a first driving motor M1, and the first and second feeding screws 25, 26 are rotationally driven by a second driving motor M2 as driving means. In this embodiment, both of these motors use a DC motor, and a driving rotational speed in a steady state during image formation was 300 (rpm) for the first driving motor M1 (as regards the second driving motor M2, description will be made later). The first driving motor M1 is directly connected with the developing sleeve 28, and the second driving motor M2 is directly connected with the first feeding screw 25. Further, the first feeding screw 25 and the second feeding screw 26 are drive-transmitted by gears with a ratio of 1:1.07.

In this embodiment, the developing container 22 is provided with an opening at a position corresponding to a developing region where the developing container 22 opposes the photosensitive drum 1. Here, the developing sleeve 28 is set at 300 rpm in rotational speed and is set at 20 mm in diameter. The photosensitive drum 1 is set at 120 rpm in rotational speed and is set at 30 mm in diameter.

Further, a distance in the closest region between the developing sleeve 28 and the photosensitive drum 1 is made about 400 μm, whereby setting is made so that the development can be effected in a state in which the developer fed to the developing portion is contacted to the photosensitive drum 1.

The developing sleeve 28 is formed of non-magnetic material such as aluminum and stainless steel, and inside thereof, a magnetic roller 28*m* as a magnetic field (generating) means is disposed in a non-rotatable state. Such a developing sleeve 28 rotates in the direction indicated by an arrow (counterclockwise direction) in the figure and carries and feeds a layer thickness-regulated two-component developer by cutting of a chain of a magnetic brush with the regulating blade 29 to a developing region in which the developing sleeve 28 opposes the photosensitive drum 1. Then, the developing sleeve 28 supplies the developer to the electrostatic latent image formed on the photosensitive drum 1, and develops the electrostatic latent image with the toner.

The regulating blade 29 as the above-described chain-cutting member is constituted by a non-magnetic member 29*a* formed with an aluminum plate or the like extending in a longitudinal axial direction of the developing sleeve 28 and by a magnetic member 29*b* such as an iron material. Further, by adjusting a gap between the regulating blade 29 and the developing sleeve 28, an amount of the developer fed to the developing region is adjusted. In this embodiment, a coating amount per unit area of the developer on the developing sleeve 28 is regulated at 30 mg/cm$^2$ by the regulating blade 29. Incidentally, the gap between the regulating blade 29 and the developing sleeve 28 is set at 200-1,000 μm, preferably, 300-700 μm. In this embodiment, the gap was set at 400 μm.

[Developer]

Next, the two-component developer, which comprises the toner and the carrier, used in this embodiment will be described. The toner contains primarily a binder resin, and a coloring agent, and as desired, particles of coloring resin, inclusive of other additives, and coloring particles having external additive such as fine particles of choroidal silica, are externally added to the toner. The toner is negatively chargeable polyester-based resin and is desired to be not less than 4 μm and not more than 10 μm, preferably not more than 8 μm, in volume-average particle size. Further, as the carrier, particles of metals, the surfaces of which have been oxidized or have not been oxidized, such as iron, nickel, cobalt, manganese, chrome, rare-earth metals, alloys of these metals, and oxide ferrite are preferably usable. The method of producing these magnetic particles is not particularly limited. A weight-average particle size of the carrier may be 20-60 μm, preferably, 30-50 μm, and the carrier may be not less than $10^7$ ohm·cm, preferably, not less than $10^8$ ohm·cm, in resistivity. In this embodiment, the carrier with a resistivity of $10^8$ ohm·cm was used.

[Supply of Developer]

Next, a developer supplying method in this embodiment will be described using FIGS. 2 and 3. Above the developing device 4, a hopper 31 accommodating a two-component developer, for supply, containing the toner and the carrier in mixture is provided. The hopper 31 constituting a supplying means includes a supplying screw 32 as a screw-shaped feeding member at a lower portion thereof, and one end of the supplying screw 32 extends to a position of a developer supply opening 30 provided at a front end portion of the developing device 4. The toner in an amount corresponding to the amount of the toner consumed by image formation is supplied from the hopper 31 to the developing container 22 through the developer supply opening 30 by a rotational force of the supplying screw 32 and gravitation of the developer. Thus, from the hopper 31, the supply developer is supplied to the developing device 4. A supply amount of the supply developer is roughly determined by the number of rotations of the supplying screw 32 as a feeding member, but this number of rotations is determined by an unshown toner supply amount controlling means. As a toner supply amount controlling method, a method of optically or magnetically detect a toner content (density) of the two-component developer and a method of detecting a density of a toner image obtained by developing a reference latent image on the photosensitive drum 1 and the like method have been known, and therefore, it is possible to select appropriately either one of these methods.

[Discharge of Developer]

Next, a developer discharging method in this embodiment will be described using FIG. 3. In this embodiment, the developing container 22 is provided with a discharge opening 40 for permitting discharge of the developer, at a predetermined height position thereof. Specifically, the discharge opening 40 is provided outside a developing sleeve placing region in a side downstream of the developing chamber 23 with respect to a developer feeding direction, the developer is discharged through the discharge opening 40. When the amount of the developer in the developing device 4 is increased in a developer supplying step as described above, depending on an increase amount, the developer is discharged through the discharge opening 40 in an overflow manner. Incidentally, a position of the discharge opening 40 with respect to the developer feeding direction is in a side upstream of a position of the developer supply opening 30 with respect to the developer feeding direction. This is because a fresh (new) developer supply is prevented from being discharged immediately. Further, a height position of the discharge opening 40 is set so that the developer amount in the developing container 22 is a proper amount, in consideration of a developer discharging characteristic described later.

Figure 4:
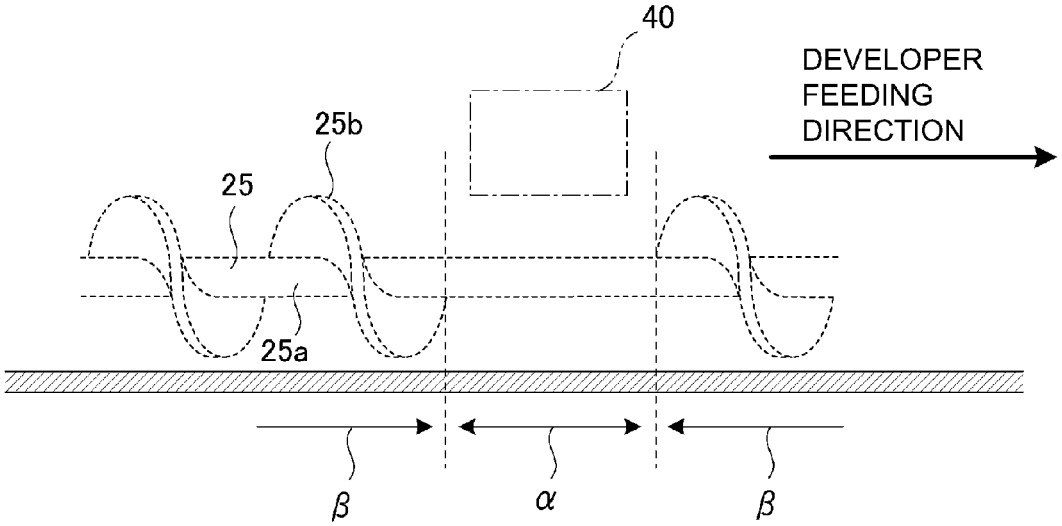
FIG. 4 is a schematic view showing a feeding screw in the neighborhood of the developing device according to the First Embodiment.

Further, in the case of this embodiment, as shown in FIG. 4, the first feeding screw 25 in the developing chamber 23 is formed by cutting away a part of a blade 25*b* formed helically around a rotation shaft 25*a*. That is, of the first feeding screw 25*a*, in a first region α including a portion opposing the discharge opening 40, only the rotation shaft 25*a* exists, and no blade 25*b* exists. On the other hand, in a second region β adjacent to the first region α, the blade 25*b* exists. By this, developer feeding power of the first feeding screw 25*a* in the first region α is made smaller than developer feeding power of the first feeding screw 25*a* in the second region β. Further, in this embodiment, in the first region α, only the rotation shaft 25*a* exists, and in the second region β, the blade 25*b* exists, and therefore, an outer diameter (outer diameter of the rotation shaft 25*a*) of the first feeding screw 25 in the first region α is smaller than an outer diameter (diameter of a circumscribed circle of the blade 25*b*) of the first feeding screw 25 in the second region.

In the case of this embodiment, by employing such a constitution, the developer is not readily fed in the first region α, and therefore, the developer stagnates in the neighborhood of the discharge opening 40 and the developer surface rises, so that the developer is discharged through the discharge opening 40. In this embodiment, a length of a first region α portion where the blade 25*b* of the first feeding screw 25 is cut away was 14 mm, and a length of a screw axial direction of the discharge opening 40 was 10 mm. A center of the first region α portion with respect to the screw axial direction and a center of the discharge opening 40 with respect to the screw axial direction are disposed so as to coincide with each other. Incidentally, positions of the first region α portion and the discharge opening 40 with respect to the screw axial direction may also be not required to coincide strictly with each other, and further, when lengths thereof are substantially the same, either one of the first region α portion and the discharge opening 40 may also be longer than the other. However, in order to further stabilize the discharge of the developer, as in this embodiment, a positional relation between both portions may preferably be caused to coincide with each other, and the first region α may preferably be made longer than the discharge opening 40.

Here, in this embodiment, the developer feeding power in the first region was made smaller than the developer feeding power in the second region by cutting away the part of the blade of the screw. However, a change in feeding power can also be made by appropriately adjusting an outer diameter, a pitch, an angle or the like of the blade, other than the cutting-away of the blade as described above. For example, the feeding screw may also be formed so that the outer diameter of the blade formed helically around the rotation shaft thereof may also be made smaller in the first region than in the second region.

Figure 5:
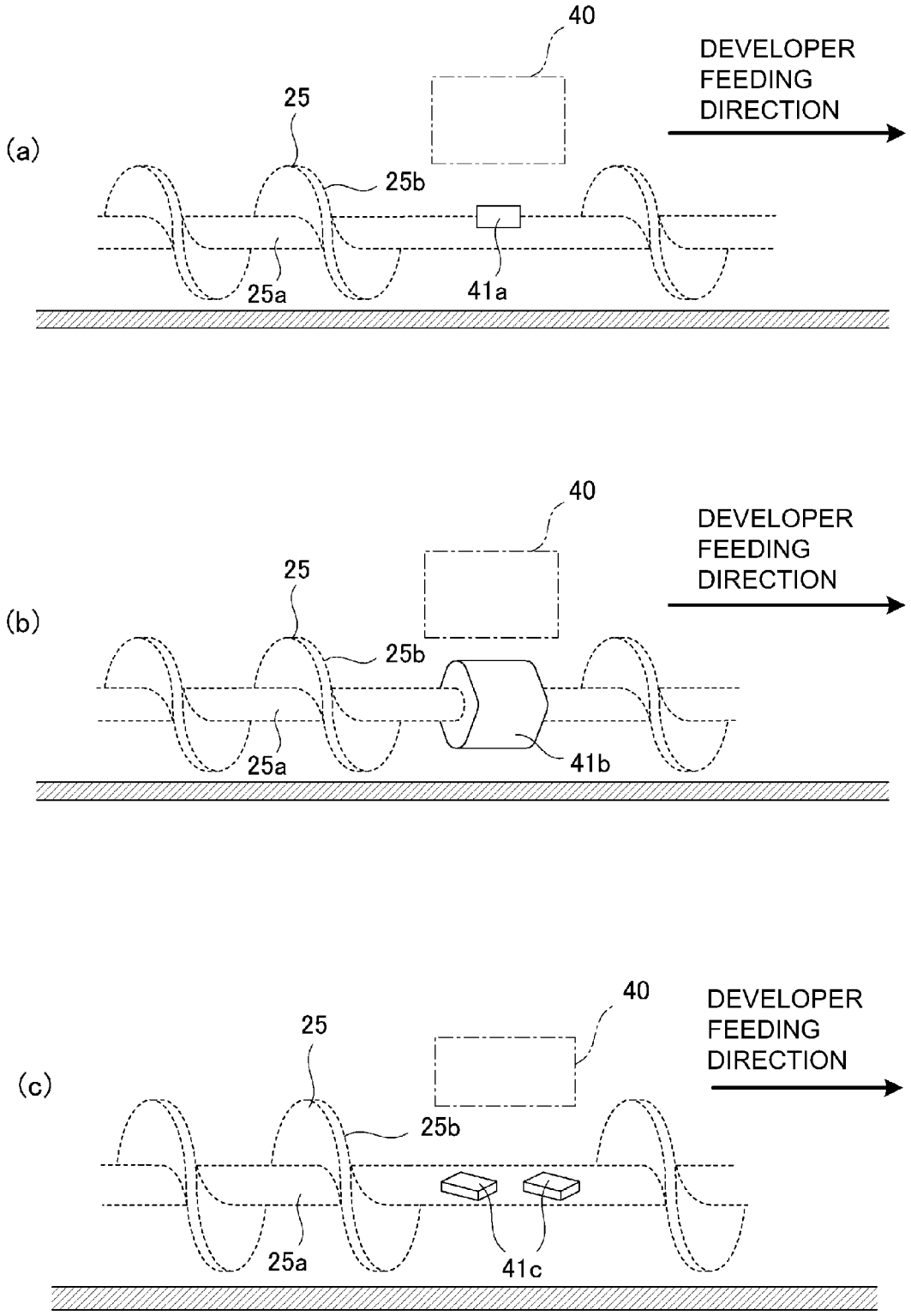
FIG. 5 includes schematic views showing other 3 examples of the feeding screw in the neighborhood of the developing device according to the First Embodiment.

Or, as shown in FIG. 5, a member 41*a*, 41*b* or 41*c* smaller in outer diameter than the blade formed in the second region may also be provided in the first region. The member 41 in (a) of FIG. 5 is a rectangular rib extending radially from the rotation shaft 25*a*. The member 41*b* in (b) of FIG. 5 is a rib having a rib cross-section that gradually narrows from a base portion toward a free end of the rotation shaft 25*a*. The ribs in (a) and (b) of FIG. 5 have cross-sectional shapes perpendicular to the rotation shafts 25*a* so as to have the same phase and the same shape along the rotation shafts 25*a*. For that reason, each of the ribs stirs the developer with respect to a rotational direction of the rotation shaft 25*a* and is substantially zero in (developer) feeding power toward the rotation shaft 25*a*. The members 41*c* in (c) of FIG. 5 are ribs each having a rectangular shape and provided with some angle with respect to the rotation shaft 25*a*. By providing these members 41*a*, 41*b*, 51*c*, it becomes possible to further stably discharge the developer by flattening and averaging the developer surface while stagnating the developer at a portion opposing the discharge opening 40. However, in the case of either constitution, the screw outer diameter in the first region is made smaller than the screw outer diameter in the second region. This is because when the screw outer diameter becomes large, the developer is easily discharged through the discharge opening 40 by jumping of the developer.

Figure 6:
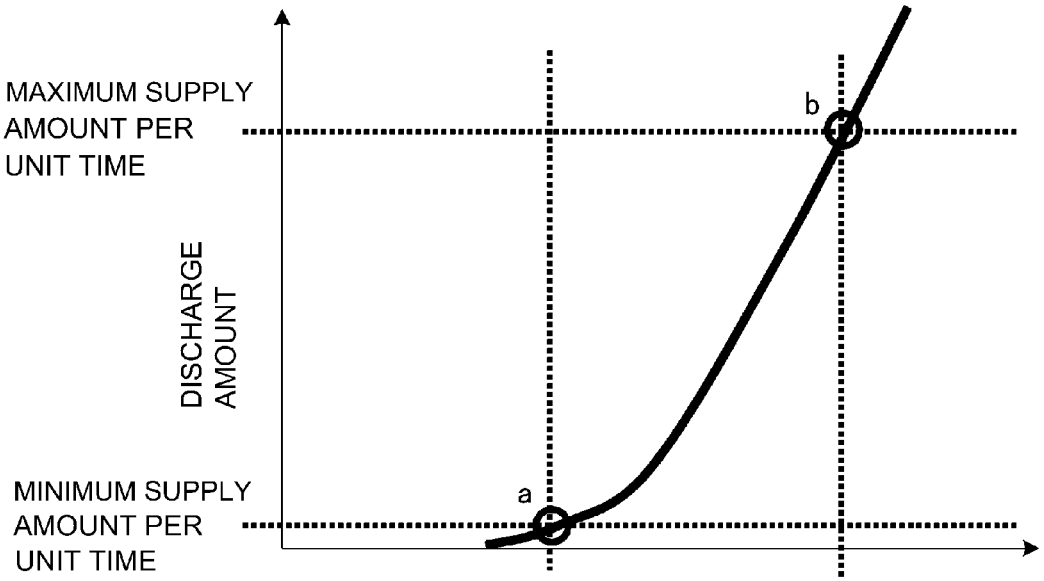
FIG. 6 is a diagram showing a discharging characteristic of a developer through a discharge opening.

FIG. 6 shows a graph of a developer discharging characteristic in this embodiment. The developer discharging characteristic is a developer discharge amount per unit time when a developer amount in the developing container 22 is a variable. The developer amount in the developing container 22 is determined by achieving a balance between the discharge amount per unit time and a difference between a supply amount per unit time of the developer supplied to the developing container 22 and an amount of the toner subjected to development (of the latent image). That is, the developer amount in the developing container 22 can roughly exhibit a value between a developer amount shown by an intersection point a between a minimum supply amount per unit time and a discharging characteristic line and a developer amount shown by an intersection point b between a maximum supply amount per unit time and a discharging characteristic line. In other words, these intersection points are points at which the developer amounts are balanced with each other during minimum supply and during maximum supply. When the developer amount in the developing container 22 becomes remarkably small, a developer carrying amount of the developing sleeve 28 is insufficient (improper coating generates), so that density non-uniformity is liable to generate. On the other hand, the developer amount in the developing container 22 becomes remarkably large, there is a possibility that developer overflow is caused during rising when the developing device 4 is changed from a drive OFF state to a drive ON state.

Ordinarily, the developer discharging characteristic can be measured in the following manner. In a state in which the developing sleeve 28 and the first and second feeding screws 25, 26 are driven at desired peripheral speeds, the developer is placed in the developing container 22 until the developer is uniformly coated on the developing sleeve 28. The developing sleeve 28 and the first and second feeding screws 25, 26 are driven at the desired peripheral speeds until developer circulation in the developing container 22 is in a steady (stable) state (ordinarily 1 or 2 minutes). From when coating on the developing sleeve 28 becomes uniform, the developer is gradually added into the developing container 22 through the developer supply opening 30. In this embodiment, the developer was added by 10 g, and the discharge amount was measured for 30 sec, so that the developer discharge amount per unit time was measured.

The above is the discharging characteristic at a certain driving speed for both of the developing sleeve 28 and the first feeding screw 25, and in the case where there are a plurality of driving speeds, the above-described minimum developer amount has to be uniformized to the possible extent at these (plurality of) driving speeds. If this is not the case, there is an increasing possibility that a problem such as improper developer coating or the like generates during speed switching.

Figure 7:
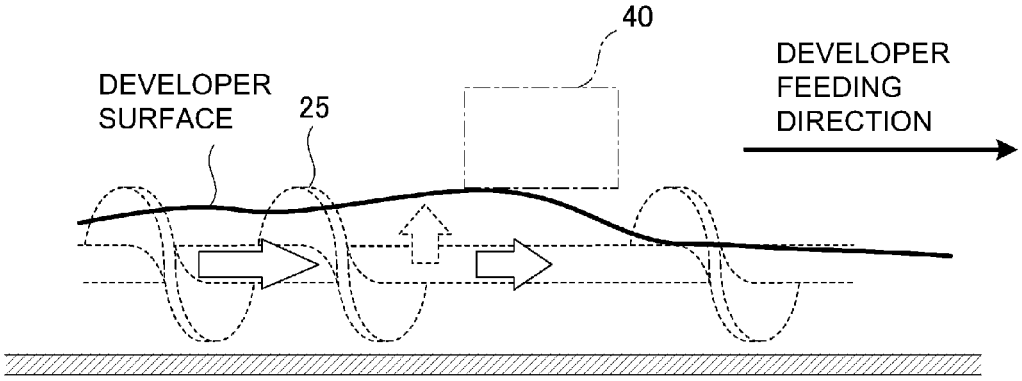
FIG. 7 is a schematic view showing a developer surface in the neighborhood of the discharge opening.

Here, as described above, by removing the blade 25*b* in the first region α including the opposing portion to the discharge opening 40 of the first feeding screw 25, in the first region α, a developer feeding performance is lower than in the second region f3 in a side upstream of the first region α with respect to the developer feeding direction. Then, as shown in FIG. 7, the developer is stagnated in this region where the developer feeding performance lowered, whereby the developer surface is raised and thus discharge (of the developer) depending on the developer surface is intended to be realized simultaneously with suppression of jumping of the developer.

Figure 8:
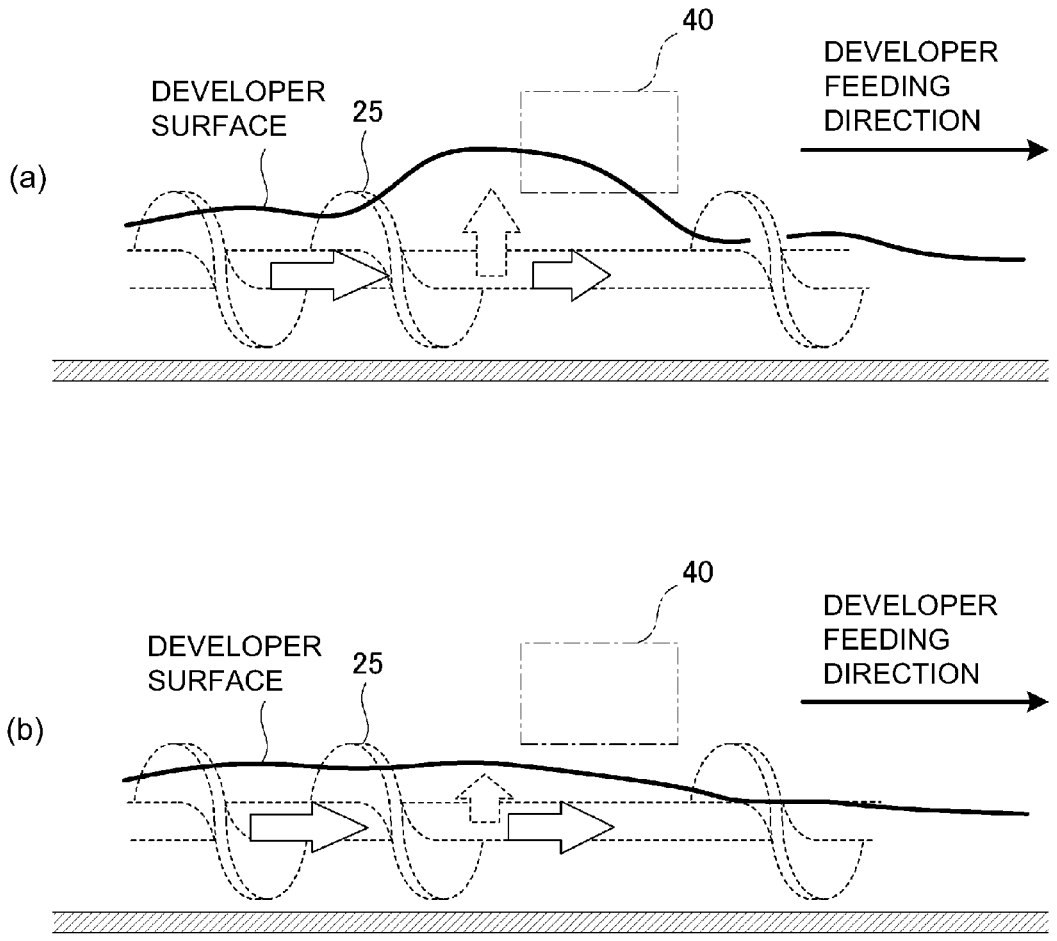
In FIG. 8, (a) is a schematic view showing the developer surface in the neighborhood of the discharge opening in the case where flowability of the developer is low, and (b) is a schematic view showing the developer surface in the neighborhood of the discharge opening in the case where the flowability of the developer is high.

However, a degree of stagnation (degree of rise of the developer surface) in this region opposing the discharge opening 40 depends remarkably on flowability of the developer. In FIG. 8, (a) shows developer surface behavior in the region opposing the discharge opening 40 in the case where a developer charge amount is high and developer flowability is low, and (b) shows the developer surface behavior in the case where the developer charge amount is low and the developer flowability is high. In the figures, solid line arrows represent developer feeding speeds at associated points. That is, when a length of the solid line arrow is long, the arrow represents that the feeding speed is fast. Further, broken line arrows represent the degree of rise of the developer surface in the region opposing the discharge opening 40, and when a length of the arrow is long, the arrow represents that the degree of rise is large.

As is apparent from (a) of FIG. 8, in the case where the developer charge amount is high and the developer flowability is low, a difference between the developer feeding speed in the region opposing the discharge opening 40 and the feeding speed in an upstream side thereof is large, so that the developer largely decreases in speed and stagnates in the region opposing the discharge opening 40. By this, the developer surface rises and developer discharge is promoted. On the other hand, as is apparent from (b) of FIG. 8, in the case where the developer amount is low and the developer flowability is high, the above-described speed difference is small, and even when a developer feeding force in the region opposing the discharge opening lowers, the developer little decreases in speed. Therefore, the develop surface does not rise, so that the developer discharge is suppressed.

This is because in the case where the developer charge amount is low, Coulomb interaction between developer particles in the developer is small. As a result, a force for transmitting, into the developer, a force received from a wall surface of the developing container 22 by a surface layer of the developer becomes small, and power for deforming a developer shape becomes small. This is a principal cause. That is, the toner in the developer exists in a state in which the toner is attracted to the carrier by an electrostatic force by being charged. Polarities among toners and among charge amounts are the same, and the toner and the carrier have different polarities. The carrier is attached to another carrier via the toner while being subjected to a repelling force by another carrier, and similarly, also toners repel each other, while the toners are attracted to each other via the carrier. Thus, with a larger electrostatic force which is an attracting force, the developer deviates from motion in accordance with gravity (i.e., flowability is high). In other words, the developer is disturbed by the electrostatic force and the flowability lowers. On the other hand, with a smaller electrostatic force, i.e., with a lower developer charge amount, the motion in accordance with gravity is not disturbed, and the flowability becomes high. In addition, this is because the force itself received from the wall surface of the developing container 22 by the surface layer of the developer is small.

Thus, when the charge amount is low and the developer discharge is suppressed, the developer amount continuously increases until the developer discharge amount and the developer supply amount balance with each other, so that a difference between a balanced developer amount and a limit developer amount of developer overflow becomes small. Further, robustness against the developer overflow becomes small, a risk of generation of the developer overflow by a moment's developer surface fluctuation such as a charge from drive OFF to drive ON of the developing device 4 (during rising or the like) becomes large.

As an effective means against such a problem, it would be considered that a screw rotational speed is increased. This is because when the screw rotational speed is increased, even in the case where the charge amount is small and the flowability is high, the developer loses the feeding force at a stagnation portion opposing the discharge opening and the developer coming from behind strikes the developer somewhat lowering in speed and thus the developer surface is raised by kinetic energy thereof. However, also in the case where the developer charge amount is high in which there is no need to increase the screw rotational speed originally, when the screw rotational speed is increased, a high load is exerted on the developer low in flowability. For this reason, screw lock due to the increase in load of the screw and developer deterioration remarkably progress. Accordingly, it is not preferable that the screw rotational speed is always increased.

[Control of Screw Rotational Speed]

Figure 9:
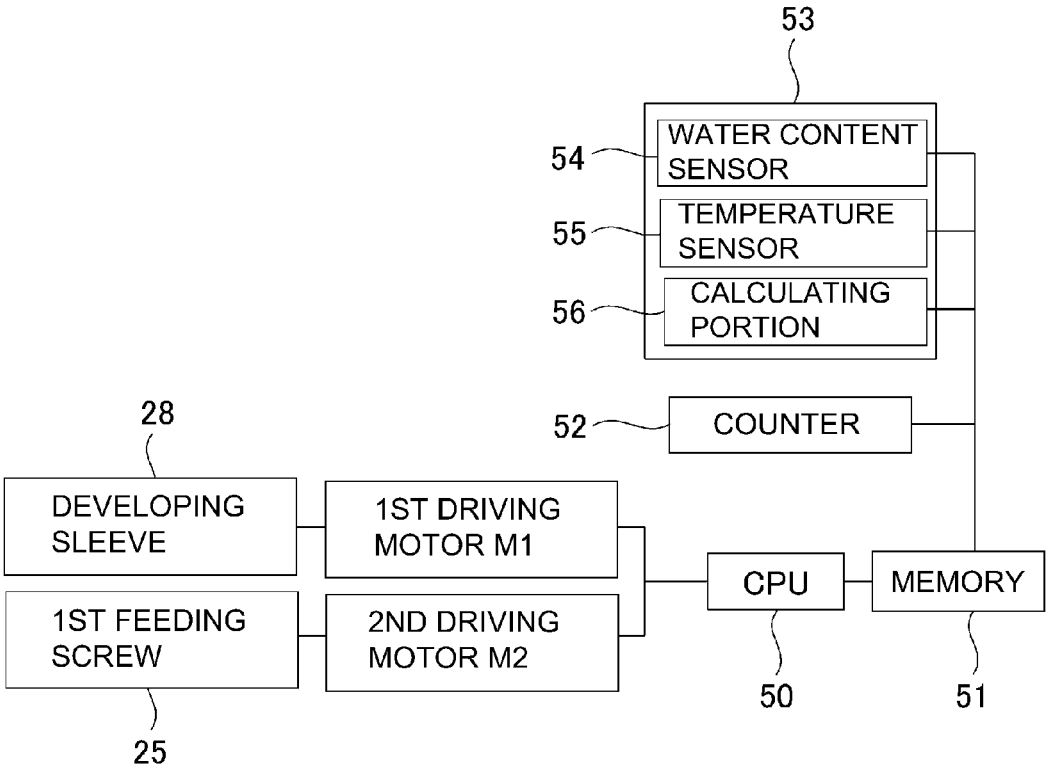
FIG. 9 is a control block diagram of the image forming apparatus according to the First Embodiment.

Therefore, in this embodiment, information on the developer charge amount is acquired and on the basis of the information, the driving speed (screw rotational speed) of the first feeding screw 25 is controlled. That is, on the basis of the information of an acquiring portion, the driving speed at which the first flowability 25 is driven by the second driving motor M2 is made faster in the case where the developer charge amount corresponds to a second charge amount lower than a first charge amount than in the case where the developer charge amount lower than a first charge amount than in the case where the developer charge amount corresponds to the first charge amount. In this embodiment, as the information on the developer charge amount, a developer humidity is detected. For this purpose, the image forming apparatus in this embodiment includes, as shown in FIG. 9, a CPU 50 as a control means, a memory 51 as a storing means, a counter 52 for counting an image formation sheet number (the number of sheets subjected to image formation), and a humidity detecting portion 53 as the acquiring portion and a humidity detecting portion. Each of the first driving motor M1 for driving the developing sleeve 28 and the second driving motor M2 for driving the first feeding screw 25 is controlled by the CPU 50.

Here, the reason why the humidity is a parameter is that the developer charge amount depends on the developer humidity. That is, there is a tendency that the developer charge amount becomes low when the developer humidity becomes high and that the developer charge amount becomes high when the developer humidity becomes low. Further, in this embodiment, the driving speed of the first feeding screw 25 is controlled while substantially maintaining a rotational speed ratio between the first and second feeding screws 25, 26 relating to the developer circulation. That is, even in the case where the rotational speed of the first feeding screw 25 opposing the discharge opening 40 is changed, a developer delivering efficiency between the screws 25, 26, or the like is not changed, and only the discharging characteristic in the neighborhood of the discharge opening 40 is controlled. By this, the developer discharge can be improved without largely disturbing entire developer circulation. However, although the rotational speed ratio between the screws relating to the developer circulation is not strictly coincided, when a difference in rotational speed ratio is about ±1% of the screw rotational speed, the difference can be regarded as being substantially constant, and therefore the rotation speed ratio may also be charged. In this embodiment, the rotational speed ratio is maintained by connecting the first and second feeding screws 25, 26 with each other by a gear.

Further, the humidity detecting portion 53 detects information (humidity information) relating to the developer humidity. In this embodiment, the humidity detecting portion 53 includes a water content sensor 54 as a water content detecting means, a temperature sensor 55 as a temperature detecting means, and a calculating portion 56 as a calculating means. The water content sensor 54 detects a water content outside of the image forming apparatus. For this purpose, the water content sensor 54 is provided outside an apparatus main assembly. The temperature sensor 55 detects a temperature in the developing container. For this purpose, the temperature sensor 55 is provided inside the developing container. The calculating portion 56 calculates the developer humidity from a relation between the temperature detected by the temperature sensor 55 and the water content detected by the water content sensor 54. For this purpose, in the calculating portion 56, tables in which a relation among the temperature, the water content and the humidity is set, and a calculating formula or the like for acquiring the humidity from a relation between the temperature and the humidity are stored, so that the humidity can be calculated from the temperature and the water content. Incidentally, calculation (computation) of the calculating portion 56 may also be made by the CPU 50. Further, the tables and the calculating formula may also be stored in the memory 51.

In this embodiment, information on the humidity detected by the humidity detecting portion 53 is stored in the memory 51. Further, the control of the driving speed of the first feeding screw 25 is effected during the rising of the developing device 4, i.e., when the first and second driving motors M1, M2 are changed from a drive OFF state to a drive ON state by input of an image forming job or the like. In this embodiment, tables as shown in Table 1 are stored in the memory 51. Then, during the rising of the developing device 4 (switching timing from OFF to ON or immediately before the timing), the CPU 50 reads humidity information at that time from the memory 51, and determines the driving speed (screw rotational speed) of the first feeding screw 25 from the tables of Table 1 on the basis of the humidity information. In this embodiment, as in Table 1, three tables are set, and each of the tables can be selected by user or the like in a service mode. Initial setting is a table 2.

TABLE 1

*UNIT IS ALL rpm

| | DEVELOPER HUMIDITY | | |
|---|---|---|---|
| | ≤15% | >15%-≤45% | >45% |
| | table 1 | | |
| SCREW SPEED | 700 | 700 | 700 |
| | table 2 | | |
| SCREW SPEED | 700 | 750 | 850 |
| | table 3 | | |
| SCREW SPEED | 700 | 800 | 950 |

In each of the tables of Table 1, the screw rotational speed (unit: "rpm") is set for a developer humidity (relative humidity). Incidentally, a table 1 is a mode in which the screw rotational speed is unchanged irrespective of the developer humidity. On the other hand, in tables 2, 3, setting is made so that the screw rotational speed is made faster in the case where the developer humidity is a second humidity (e.g., larger than 15%) higher than a first humidity than in the case where the developer humidity is the first humidity (e.g., 15% or less). That is, the screw rotational speed is made faster in the case where the humidity information detected by the humidity detecting portion 53 corresponds to the second humidity higher than the first humidity than in the case where the humidity corresponds to the first humidity.

Incidentally, in this embodiment, the humidity information used for the screw rotational speed is renewed by an instruction of the CPU 50 at predetermined timing. The predetermined timing is during main switch actuation of the image forming apparatus, during start of an image forming job, at the time of a lapse of a predetermined time, and the like, but in this embodiment, the information on the humidity is renewed at the time when image formation of not less than a predetermined sheet number is effected. For this reason, the image formation sheet number is counted by a counter 52, and renewal of the humidity information stored in the memory 51 is made by the CPU 50 when a value counted by the counter 52 is not less than the predetermined sheet number during the rising of the developing device 4. Then, the CPU 50 controls the screw rotational speed on the basis of this humidity information.

Figure 10:
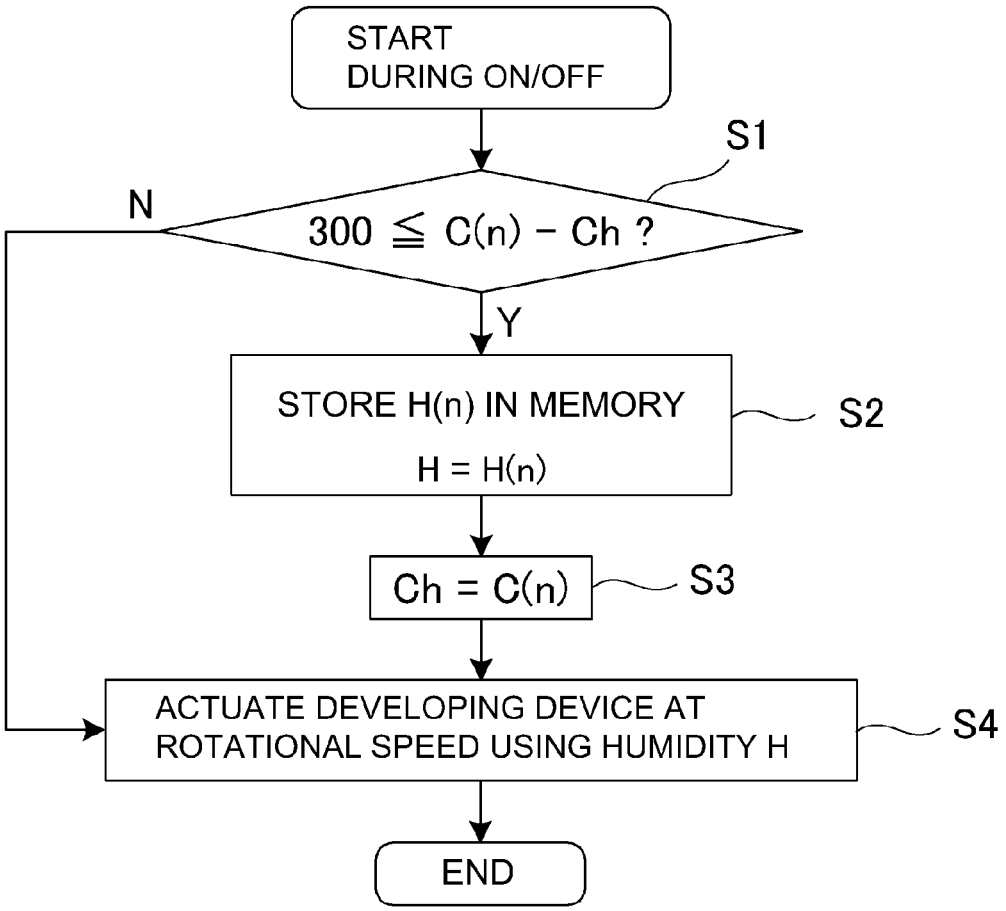
FIG. 10 is a flowchart of control during rising of the developing device in the First Embodiment.

Using FIG. 10, a specific example of control in this embodiment will be described. In this embodiment, a flowchart of FIG. 10 is executed every rising (OFF/ON) of the developing device 4, and drive is started at a screw rotational speed acquired therefrom. That is, in this embodiment, a change timing of the screw rotational speed is timing of developing driving OFF/ON.

First, every developing drive OFF/ON, an image formation sheet number (print number) C(n) at that time is read from the memory 51, and is compared with a print number Ch in which the last screw rotational speed is changed depending on the humidity (S1). Then, when C(n)−Ch is not less than 300 sheets (Y of S1), the developer humidity at that time is read from the memory 51, and is set at a developer humidity H used for screw rotational speed control (S2). The developer humidity is calculated every printing and is stored in the memory 51. Thereafter, a print number C(n) at that time is set at Ch which is the sheet number in which the screw rotational speed is last changed (S3), and the developing drive is actuated using the developer humidity H stored in the memory 51 (S4). That is, the screw rotational speed at the developer humidity H is read from the table of Table 1, and the drive of the developing device is actuated at the screw rotational speed. On the other hand, in S1, when the difference from the print number Ch in which the last screw rotational speed is changed depending on the humidity is less than 300 sheets (N of S1), the developing drive is actuated using the last developer humidity H (S4). That is, H is not renewed, and therefore the developing drive is actuated at the last screw rotational speed as it is.

By effecting the control as described above, the screw rotational speed is changed at a certain frequency (300 sheets or more in this embodiment), so that the screw rotational speed corresponding to the developer humidity at that time can be set. The above frequency may also be one or more sheet, i.e., the screw rotational speed may also be changed every printing, but an actual humidity change of the developer relative to a humidity change in the developing container is slow, and therefore, there is no need to change the frequency and in this embodiment, the frequency was the above-described sheet number.

Further, in this embodiment, the control of FIG. 10 is effected during the rising of the developing device 4, but this control may also be effected at another timing, for example, at an interval (sheet interval) between an image and an image during execution of the image forming job. However, the control of FIG. 10 is accompanied with a change in screw rotational speed depending on a change in humidity, and therefore may preferably be effected during the rising of the developing device 4. That is, it is relatively difficult to effect the control of the change in screw rotational speed during the drive of the developing device 4, and therefore the change in speed can be easily made by actuating the developing device 4 at the speed changed during the drive actuation. Further, in this embodiment, the OFF/ON of the developing drive is forcedly executed once every predetermined image formation sheet number (e.g., 150-170 sheets) even during execution of the image forming job. For this reason, irrespective of the image formation sheet number of the image forming job, the control of FIG. 10 is effected at a certain frequency.

In the case of this embodiment as described above, in a state in which the charge amount is low in which the developer flowability is high, i.e., in a state in which the developer humidity is high, control is effected so that the driving speed of the first feeding screw 25 is fast. For this reason, even when the developer flowability is high and the developer is not readily stagnated in the neighborhood of the discharge opening 40, the developer surface is raised, so that the discharge of the developer can be properly performed. That is, as described above, when the screw rotational speed is increased, even in the case where the flowability is high, the developer loses the feeding force at a stagnation portion opposing the discharge opening and the developer coming from behind strikes the developer somewhat lowering in speed and thus the developer surface is raised by kinetic energy thereof. For this reason, the developer can be properly discharged through the discharge opening 40.

Figure 11:
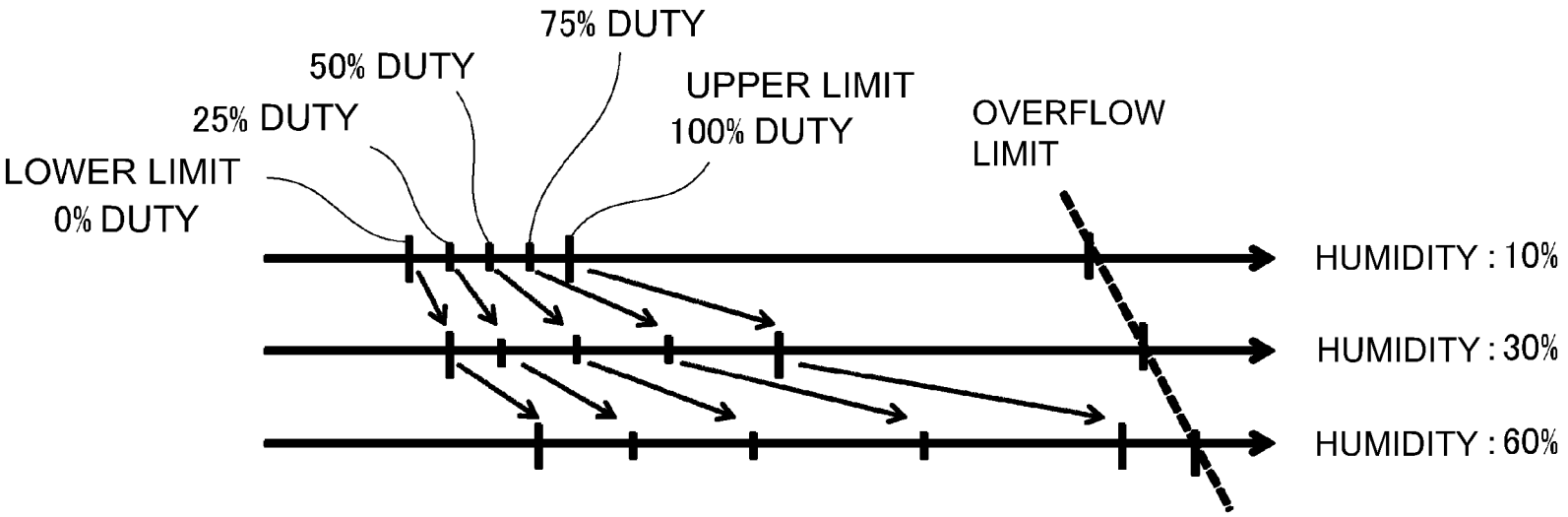
FIG. 11 is a diagram showing a change in developer amount in a developing container relative to a developer humidity at each image DUTY in a comparison example to the present invention.
Figure 12:
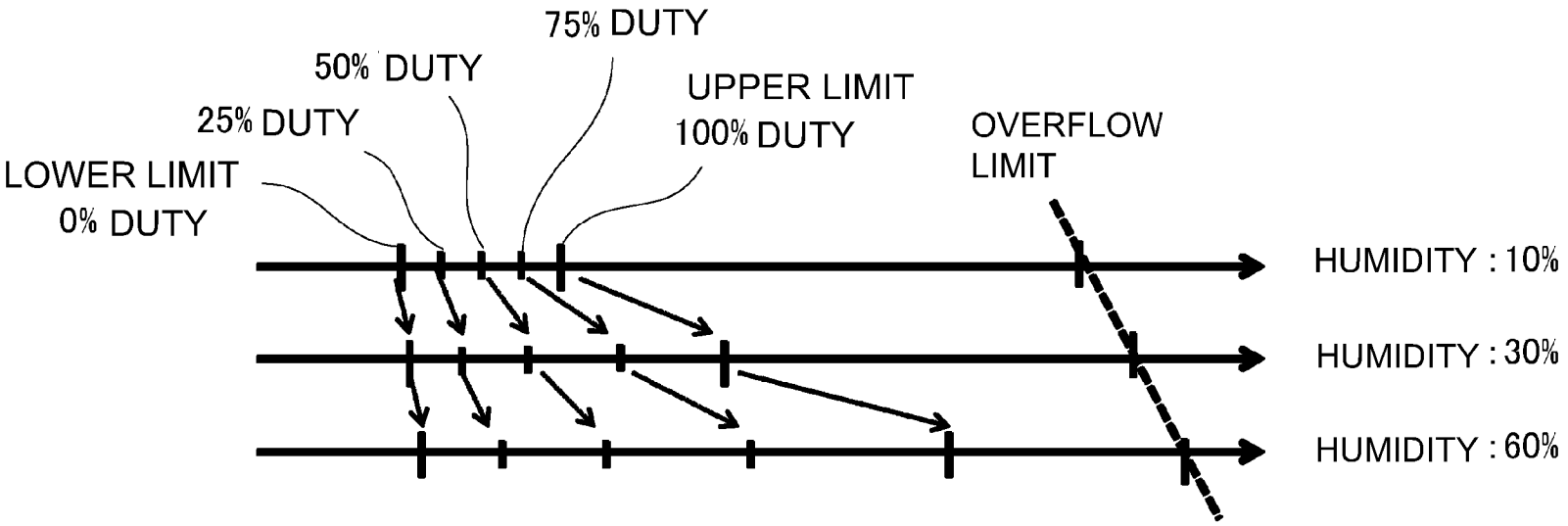
FIG. 12 is a diagram showing a change in developer amount in a developing container relative to a developer humidity at each image DUTY in Embodiment 1 of the present invention.

An effect of this embodiment as described above will be described using FIG. 11 and FIG. 12. FIGS. 11, 12 show results of an experiment conducted for confirming the effect of this embodiment. The experiment was conducted under the following condition for each of a comparison example in which the screw rotational speed is made constant irrespective of the developer humidity and Embodiment 1 in which the screw rotational speed is changed depending on the developer humidity as in this embodiment. First, an image DUTY (image duty) was changed to a plurality of levels, and the developing device was driven in each of environments different in developer humidity and developer amounts in the developing containers were compared. FIGS. 11, 12 show the developer amounts, and FIG. 11 shows a result of the comparison example and FIG. 12 shows a result of Embodiment 1.

Incidentally, in the comparison example, the screw rotational speed was constant and was 700 (rpm). Further, in Embodiment 1, the screw rotational speed was controlled using the table 2 of Table 1. Further, the image DUTY is represented by a percentage of a ratio of a total amount of the toner of the image on the photosensitive drum to a maximum total amount of the toner per one sheet of the image on the photosensitive drum. The maximum total amount is a toner consumption amount when the latent image is developed with the toner on the entire surface of an image formable region on the photosensitive drum (during whole region solid development), and the image DUTY during the whole region solid development is 100%.

From FIG. 11, in the case of the comparison example in which the screw rotational speed is not controlled depending on the humidity and is made constant, the developer amount largely fluctuates depending on the humidity. Particularly, in the case where the developer humidity is 60%, the developer discharge amount remarkably lowers and is compensated for with the developer amount in the developing container, and therefore the developer amount remarkably increases compared with that when the humidity is 10%. Broken lines in FIGS. 11, 12 represent limit lines of overflow, and when the developer humidity is high, the charge amount lowers and the bulk lowers and therefore also the overflow limit line shifts toward a large side, but an increase in developer amount due to improper developer discharge in a high humidity becomes larger in degree than the increase in developer amount of the overflow limit line.

In conclusion, in the comparison example, robustness becomes lower against the developer overflow with a higher humidity, so that a risk of generation of the developer overflow by a moment's developer surface fluctuation during the drive actuation of the developing device or the like becomes large. On the other hand, in the case of Embodiment 1, as shown in FIG. 12, the screw rotational speed is controlled depending on the developer humidity, and therefore it is understood that the improper discharge in the high-humidity side is alleviated and the robustness against the developer overflow is ensured. Here, it is understood that the developer charge amount is influenced by not only the developer humidity but also the image DUTY. Therefore, in both of the comparison example and Embodiment 1, when the image DUTY becomes high, replacement of the toner in the developing container becomes large and therefore, the charge amount lowers and the developer amount increases.

Further, in the case of this embodiment, in the case where the developer humidity is low and the charge amount is high and the flowability is low, the screw rotational speed is set at a low value. For this reason, by suppressing a high load exerted on the developer low in flowability, it is possible to prevent screw lock due to the increase in screw load and developer deterioration.

Second Embodiment

Figure 13:
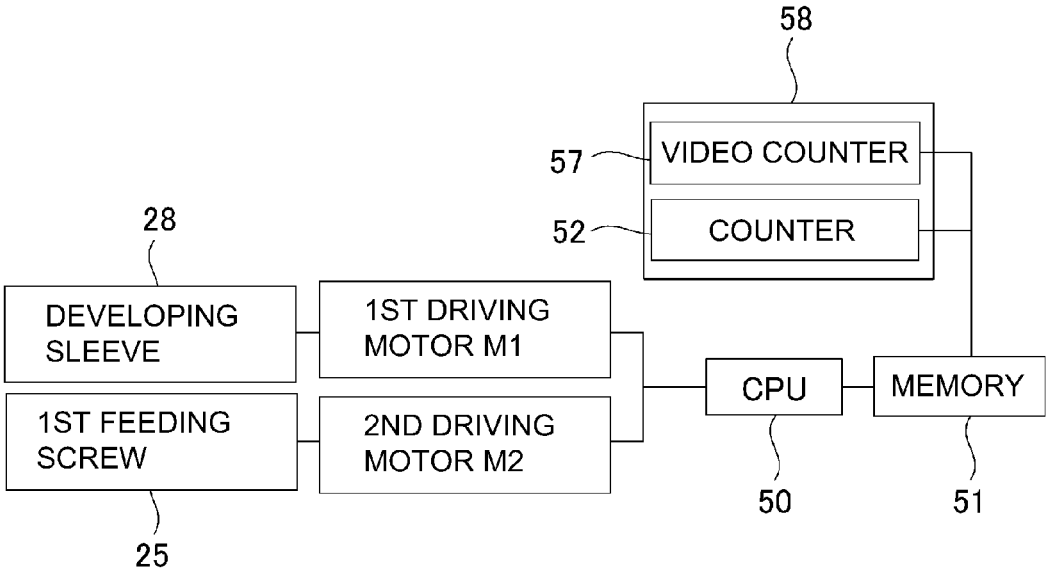
FIG. 13 is a control block diagram of an image forming apparatus according to a Second Embodiment of the present invention.
Figure 14:
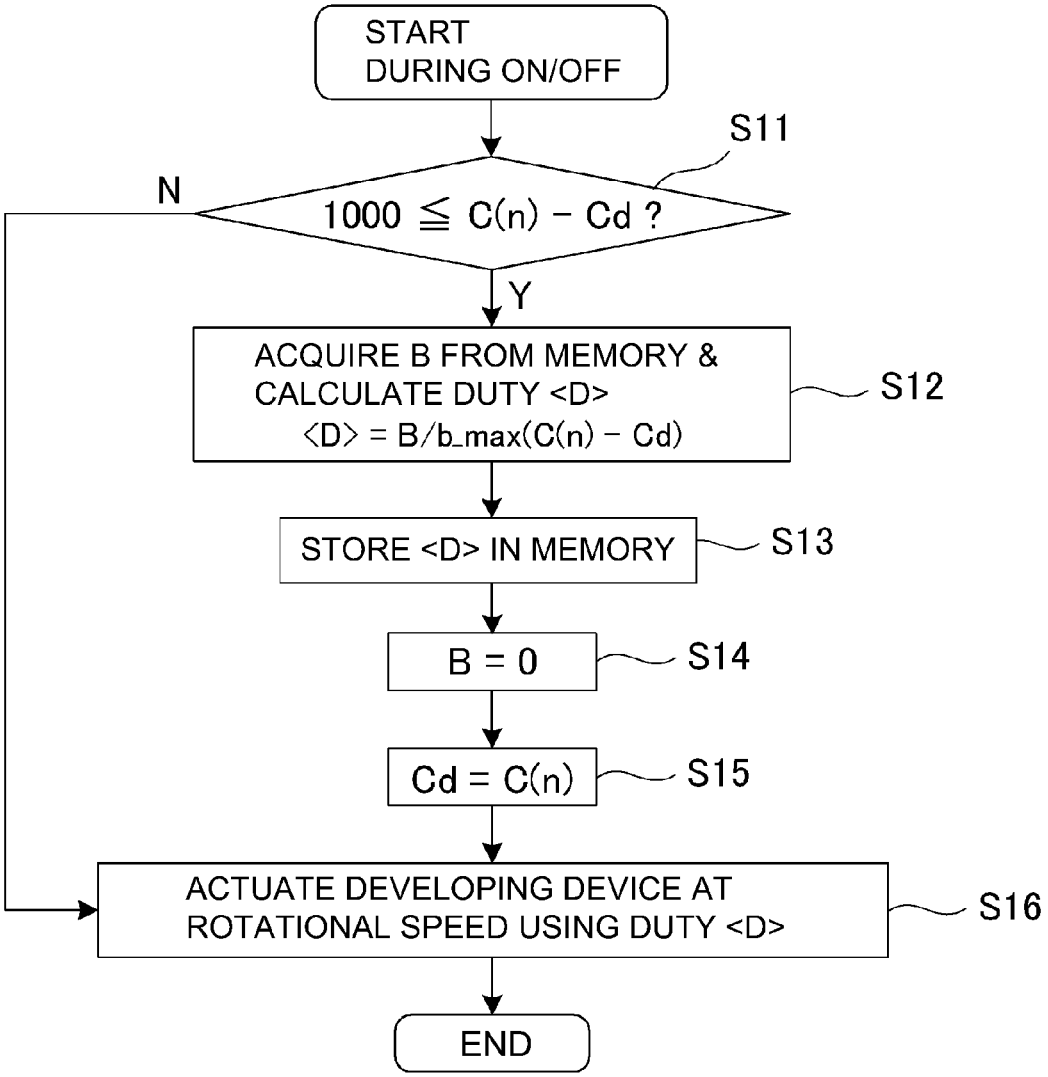
FIG. 14 is a flowchart of control during rising of a developing device in the Second Embodiment.

Second Embodiment of the present invention will be described using FIG. 13 to FIG. 15. In the above-described First Embodiment, by controlling the screw rotational speed depending on the developer humidity, the discharging characteristic of the developer at a low charge amount in a high-humidity environment was promoted, so that the robustness against the developer overflow was improved. However, the developer charge amount largely depends on not only the environment but also the image DUTY. Therefore, in this embodiment, the developer discharge is improved by controlling the screw rotational speed depending on the image DUTY. Other constitutions and actions are similar to those in the above-described First Embodiment, and therefore redundant illustration and description will be omitted or briefly made, and to the same constituent elements, the same reference symbols are added, and in the following, a portion different from First Embodiment will be principally described.

First, the reason why the developer charge amount changes depending on the image DUTY is that a stirring time in the developing container 22 with respect to the supplied toner amount is different and thus a stirring time distribution of the toner in the developing container 22 is different. That is, in the case where an image with a high image DUTY is continuously printed, most of the toner in the developing container 22 is used for developing the latent image, and in place therefor, a new (fresh) toner is supplied. At this time, with a higher DUTY, a toner in a large amount is supplied in a short time as a matter of course. Therefore, the stirring time distribution of the toner in the developing container 22 is occupied mostly by the short time, so that the charge amount as a whole lowers due to insufficient stirring. On the other hand, in the case where a low-DUTY image is continuously printed, relatively little toner is replaced, so that the stirring time distribution of the toner in the developing container 22 is occupied mostly by a long time. Therefore, the charge amount increases as a whole.

Thus, in this embodiment, as the information on the developer charge amount, the image DUTY is used. For this purpose, the image forming apparatus in this embodiment includes, as shown in FIG. 13, a CPU 50 as a control means, a memory 51 as a storing means, a counter 52 for counting an image formation sheet number (the number of sheets subjected to image formation), and a video counting portion 57. In this embodiment, the counter 52 and the video counting portion 57 constitute a toner consumption amount detecting portion 58 as an acquiring portion and a toner consumption amount detecting means.

The video counting portion 57 integrates the number of image dots formed on the photosensitive drum, i.e., a video count. For example, the video counting portion 57 integrates a level (0-255 levels) for each (one) pixel of an inputted image data (for example, in 600 dpi), for each of image (sheet) surfaces. Further, the image formation sheet number is counted by a counter 52, and a video count corresponding to a certain image formation sheet number is integrated and is divided by a value obtained by multiplying the image formation sheet number by the video count with a 100%-DUTY, so that an average image DUTY is acquired. That is, the average image DUTY is an average image DUTY of the certain image formation sheet number and corresponds to a value relating to a consumption amount of the toner consumed per unit time with the image formation. Accordingly, when the average image DUTY is high, it shows the case where the consumption amount of the toner consumed per unit time was large, and in this case, a new (fresh) developer in a large amount is supplied into the developing container 22, so that there is a tendency that the developer charge amount lowers. On the other hand, when the average image DUTY is low, it shows the case where the consumption amount of the toner consumed per unit time was small, and in this case, replacement of the developer in the developing container 22 is small, so that there is a tendency that the developer charge amount increases. In this embodiment, the average image DUTY is calculated by the toner consumption amount detecting portion 58.

In this embodiment, information obtained by calculating the average image DUTY (toner consumption amount) by the toner consumption amount detecting portion 58 is stored in the memory 51. Further, also in the case of this embodiment, during the rising of the developing device 4 (the time of switching from OFF to ON), the CPU 50 reads the average image DUTY at that time from the memory 51, and determines the driving speed (screw rotational speed) of the first feeding screw 25 from the tables of Table 2 on the basis of information thereof. In this embodiment, as in Table 2, three tables are set, and each of the tables can be selected by the user or the like in a service mode. Initial setting is a table 2.

TABLE 2

*UNIT IS ALL rpm

| | AVERAGE IMAGE DUTY | | |
|---|---|---|---|
| | ≤20% | >20%-≤50% | >50% |
| table 1 | | | |
| SCREW SPEED | 700 | 700 | 700 |
| table 2 | | | |
| SCREW SPEED | 700 | 800 | 950 |
| table 3 | | | |
| SCREW SPEED | 700 | 850 | 1100 |

In each of the tables of Table 2, the screw rotational speed (unit: "rpm") is set for the average image DUTY. Incidentally, a table 1 is a mode in which the screw rotational speed is unchanged irrespective of the average image DUTY. On the other hand, in tables 2, 3, setting is made so that the screw rotational speed is made faster in the case where the average image DUTY (toner consumption amount) corresponds to a second consumption amount more than a first consumption amount than in the case where the average image DUTY (toner consumption amount) is the first consumption amount. For example, when the average image DUTY as a value relating to the first consumption amount is 20% or less, the screw rotational speed is 700 rpm, whereas when the average image DUTY as a value relating to the second consumption amount is larger than 20%, the screw rotational speed is 800 rpm or more.

Incidentally, in this embodiment, calculation of the average image DUTY used for the screw rotational speed is made at the time of image formation of a predetermined number of sheets. For this reason, the image formation sheet number is counted by a counter 52, and the average image DUTY is calculated and stored in the memory 51 when a value counted by the counter 52 is not less than the predetermined sheet number during the rising of the developing device 4. Then, the CPU 50 controls the screw rotational speed on the basis of this average image DUTY. Accordingly, in the case of this embodiment, the average image DUTY is an average of image DUTY values from renewal (control) of the screw rotational speed to subsequent renewal of the screw rotational speed.

Using FIG. 14, a specific example of control in this embodiment will be described. Also in this embodiment, a flowchart of FIG. 14 is executed every rising (OFF/ON) of the developing device 4, and drive is started at a screw rotational speed acquired therefrom. That is, in this embodiment, a change timing of the screw rotational speed is timing of developing driving OFF/ON.

First, every developing drive OFF/ON, an image formation sheet number (print number) C(n) at that time is read from the memory 51, and then is compared with a print number Cd in which the last screw rotational speed is changed depending on the average image DUTY (S11). When C(n)−Ch is not less than 1000 sheets (Y of S11), an integrated image dot number B, at that time, acquired separately by calculation is read from the memory 51. Then, by dividing the image dot number B by b_max(C(n)−Cd), the screw rotational speed is renewed depending on the last average image DUTY and then an average image DUTY <D> per printing of one sheet until that time is acquired (S12). Here, b_max is an image dot number when the average image DUTY is 100%-image DUTY at the time of printing of one sheet of A4 in size. Further, the integrated image dot number B is the number added in real time by calculating B=B+b(n) every printing of one sheet, where an image dot number at that time is b(n).

The average image DUTY <D> acquired in S12 is stored in the memory 51 (S13), and the integrated dot number B is cleared to zero for calculation of a subsequent average image DUTY (S14). C(n) at that time is set at the most recent sheet number Cd in which the screw rotational speed is changed depending on the average image DUTY (S15), and the developing drive is actuated using the average image DUTY <D> stored in the memory 51 (S16). That is, the screw rotational speed at the average image DUTY <D> is read from the table of Table 2, and the drive of the developing device is actuated at the screw rotational speed. On the other hand, in S11, when the difference from the print number Cd in which the last screw rotational speed is changed depending on the average image DUTY is less than 1000 sheets (N of S11), the developing drive is actuated using the last average image DUTY <D> (S16). That is, <D> is not renewed, and therefore the developing drive is actuated at the last screw rotational speed as it is. By effecting the sequence as described above, the screw rotational speed is renewed at a certain frequency (1000 sheets or more in this embodiment), so that the screw rotational speed corresponding to the average image DUTY at that time can be set.

In the case of this embodiment as described above, in a state in which the charge amount is low in which the developer flowability is high, i.e., in a state in which the average image DUTY is high (toner consumption amount is large), control is effected so that the driving speed of the first feeding screw 25 is fast. For this reason, similarly as in the First Embodiment, even when the developer flowability is high and the developer is not readily stagnated in the neighborhood of the discharge opening 40, the developer surface is raised, so that the discharge of the developer can be properly performed.

An effect of this embodiment as described above will be described using FIG. 11 and FIG. 15. FIGS. 11, 15 show results of an experiment conducted for confirming the effect of this embodiment. The experiment was conducted under the following condition for each of a comparison example in which the screw rotational speed is made constant irrespective of the average image DUTY and Embodiment 2 in which the screw rotational speed is changed depending on the average image DUTY as in this embodiment. First, an image DUTY (image duty) was changed to a plurality of levels, and the developing device was driven in each of environments different in developer humidity and developer amounts in the developing containers were compared. FIGS. 11, 15 show the developer amounts, and FIG. 11 shows a result of the comparison example and FIG. 15 shows a result of Embodiment 2. In the comparison example, the screw rotational speed was constant and was 700 (rpm). Further, in Embodiment 2, the screw rotational speed was controlled using the table 2 of Table 2.

From FIG. 11, in the case of the comparison example in which the screw rotational speed is not controlled depending on the average image DUTY and is made constant, the developer amount fluctuates depending on the average image DUTY. Particularly, in the case where the average image DUTY is 10%, the developer discharge amount remarkably lowers and is compensated for with the developer amount in the developing container, and therefore the developer amount increases compared with that when the average image DUTY is 0%. Further, this tendency also depends on the developer humidity as described in the First Embodiment, and is conspicuous particularly in a high-humidity environment. In conclusion, as described above, in the comparison example, robustness becomes lower against the developer overflow with a higher image DUTY and a higher humidity, so that a risk of generation of the developer overflow by a moment's developer surface fluctuation during the drive OFF/ON or the like becomes large.

Figure 15:
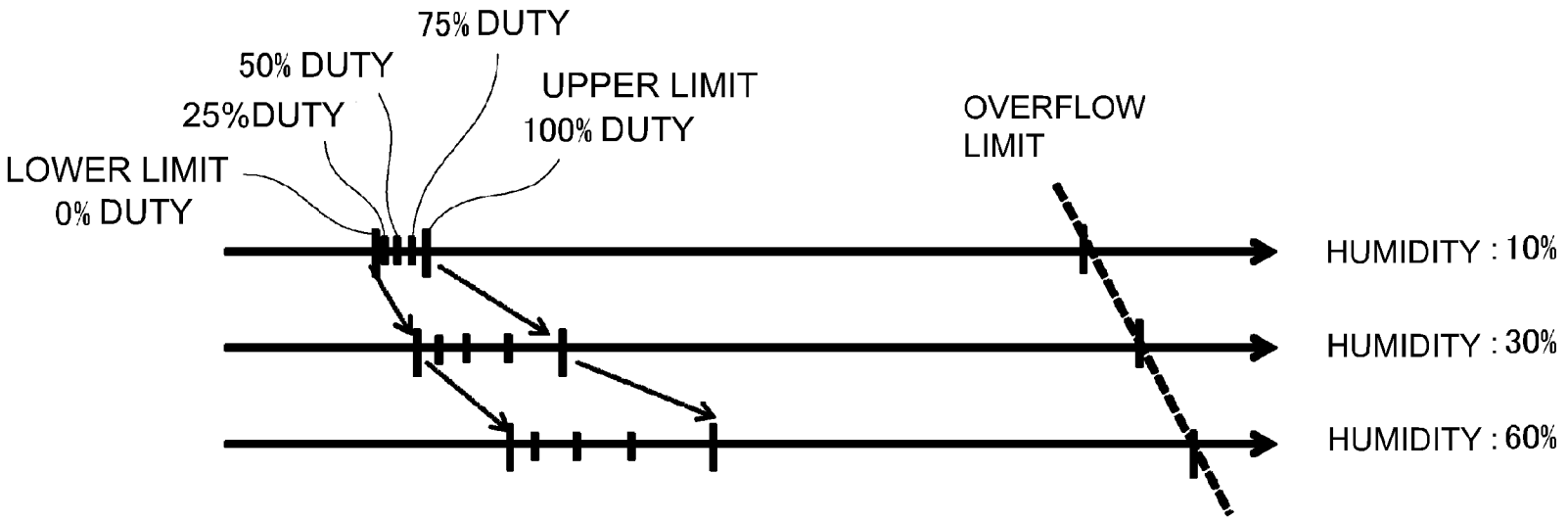
FIG. 15 is a diagram showing a change in developer amount in a developing container relative to a developer humidity at each image DUTY in Embodiment 2 of the present invention.

On the other hand, in the case of Embodiment 2, as shown in FIG. 15, the screw rotational speed is controlled depending on the average image DUTY, and therefore a variation in discharge amount due to the image DUTY is suppressed and a variation in developer amount at 0%-100% is small throughout an entire humidity environment. Therefore, it is understood that compared with the comparison example, the robustness is improved against the developer overflow.

Third Embodiment

Figure 16:
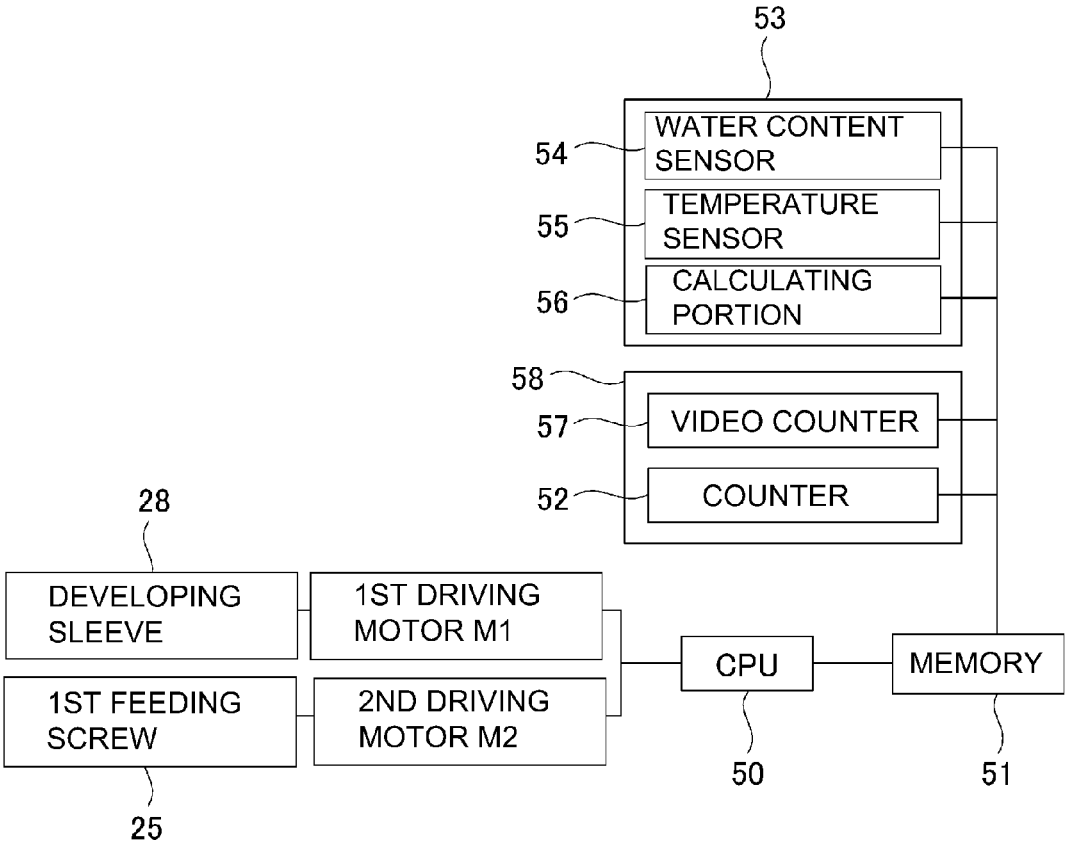
FIG. 16 is a control block diagram of an image forming apparatus according to a Third Embodiment of the present invention.
Figure 17:
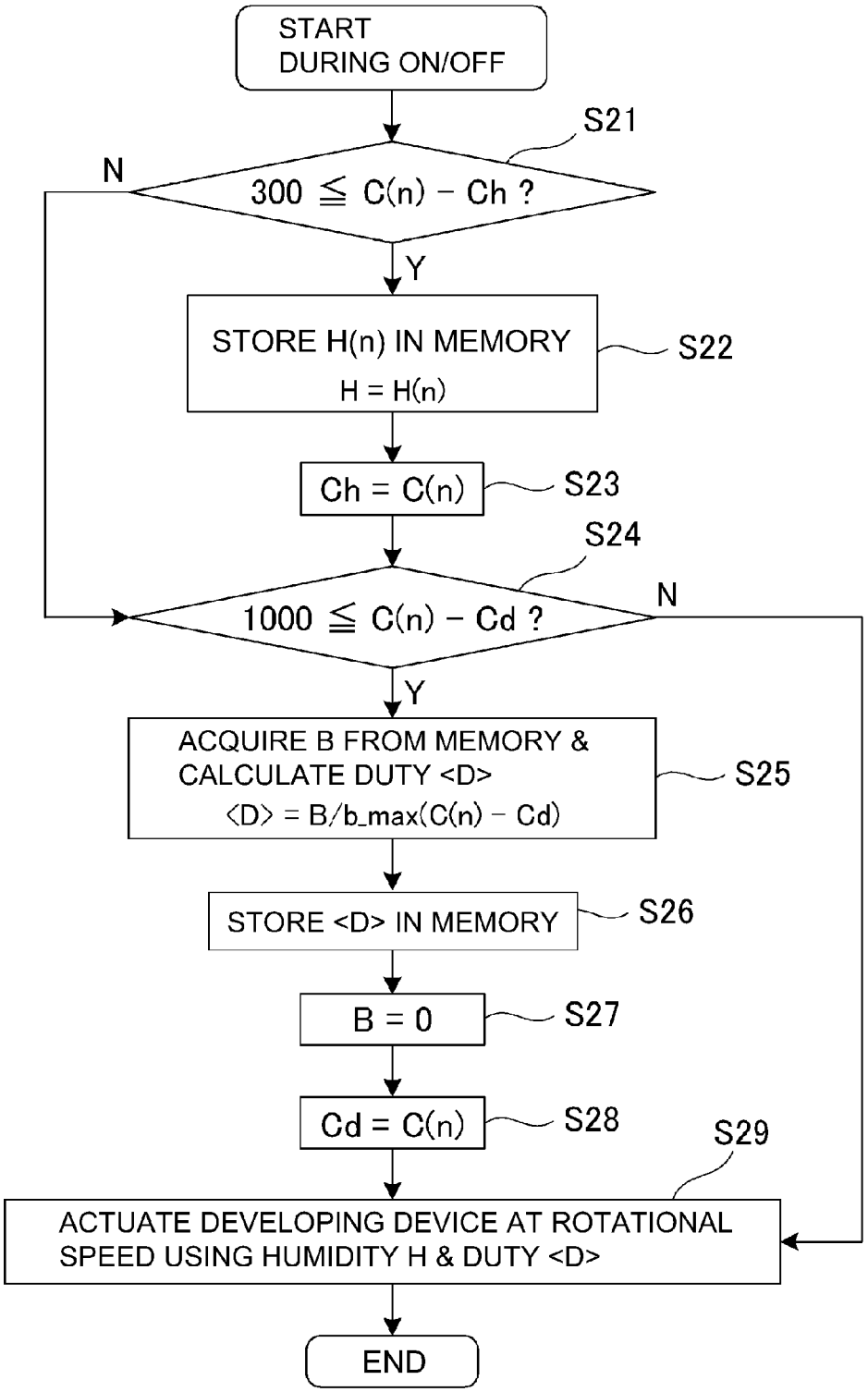
FIG. 17 is a flowchart of control during rising of a developing device in the Third Embodiment.

The Third Embodiment of the present invention will be described using FIG. 16 to FIG. 18. In the above-described First and Second Embodiments, by controlling the screw rotational speed depending on the developer humidity or the average image DUTY, respectively, the discharging characteristic of the developer at a low charge amount was promoted, so that the robustness against the developer overflow was improved. In this embodiment, the developer discharge is further improved by controlling the screw rotational speed depending on these two parameters consisting of the developer humidity and the image DUTY. Other constitutions and actions are similar to those in the above-described First and Second Embodiments, and therefore redundant illustration and description will be omitted or briefly made, and to the same constituent elements, the same reference symbols are added, and in the following, a portion different from the First and Second Embodiments will be principally described.

Thus, also in this embodiment, as the information on the developer charge amount, the developer humidity and the image DUTY is used. For this purpose, the image forming apparatus in this embodiment includes, as shown in FIG. 16, a CPU 50 as a control means, a memory 51 as a storing means, a counter 52 for counting an image formation sheet number (the number of sheets subjected to image formation), a humidity detecting portion 53 as an acquiring portion and a humidity detecting means, and a video counting portion 57. Also in this embodiment, the counter 52 and the video counting portion 57 constitute the toner consumption amount detecting portion 58 as an acquiring portion and a toner consumption amount detecting means. Further, also in the case of this embodiment, the humidity detecting portion 53 includes a water content sensor 54 as a water content detecting means, a temperature sensor 55 as a temperature detecting means and a calculating portion 56 as a calculating means. Structures and actions of the respective portions are similar to those in the First and Second Embodiments.

In the case of this embodiment, the CPU 50 stores a humidity (humidity information) detected by the humidity detecting portion 53 in the memory 51 when image formation is effected on the recording material in a first sheet number or more from the time when the humidity (humidity information) detected by the humidity detecting portion 53 is stored the lost time in the memory 51. That is, the humidity information in the memory 51 is renewed. Further, the CPU 50 stores an average image DUTY detected by the toner consumption amount detecting portion 58 in the memory 51 when image formation is effected on the recording material in a second sheet number or more from the time when the average image DUTY detected by the toner consumption amount detecting portion 58 is stored the last time in the memory 51. Here, the second sheet number is different from the first sheet number and is more than the first sheet number. For example, the first sheet number is 300 sheets, and the second sheet number is 1000 sheets.

Then, the CPU 50 controls the second driving motor M2 on the basis of a speed set from a relation between the humidity (humidity information) and the average image DUTY (toner consumption amount) which are stored in the memory 51. In this embodiment, the CPU 50 determines a driving speed (screw rotational speed) of the first feeding screw 25 from a table of Table 3. Further, in this embodiment, as in Table 3, three tables are set, and each of the tables can be selected by user or the like in a service mode. Initial setting is a table 2. Here, the reason why a plurality of tables are provided in a service mode as in Table 3 is that a more proper table can be selected depending on a particular user or region (environment).

TABLE 3

*UNIT IS ALL rpm

| | | AVERAGE IMAGE DUTY | | |
|---|---|---|---|---|
| | | ≤20% | >20%-≤50% | >50% |
| | | table 1 | | |
| HUMIDITY | ≤15% | 700 | 700 | 700 |
| | >15%-≤45% | 700 | 700 | 700 |
| | >45% | 700 | 700 | 700 |
| | | table 2 | | |
| HUMIDITY | ≤15% | 700 | 700 | 700 |
| | >15%-≤45% | 750 | 850 | 1000 |
| | >45% | 850 | 1000 | 1200 |
| | | table 3 | | |
| HUMIDITY | ≤15% | 700 | 700 | 700 |
| | >15%-≤45% | 800 | 900 | 1100 |
| | >45% | 960 | 1100 | 1400 |

In each of the tables of Table 3, the screw rotational speed (unit: "rpm") is set for the developer humidity and the average image DUTY. Incidentally, a table 1 is a mode in which the screw rotational speed is unchanged irrespective of the developer humidity and the average image DUTY. On the other hand, in tables 2, 3, setting is made so that the screw rotational speed is made faster in the case where the developer humidity is a second humidity (e.g., larger than 15%) higher than a first humidity than in the case where the developer humidity is the first humidity (e.g., 15% or less). And, setting is made so that the screw rotational speed is made faster in the case where the average image DUTY (toner consumption amount) corresponds to a second consumption amount (e.g., more than 20%) heater than a first consumption amount than in the case where the average image DUTY (toner consumption amount) corresponds to the first consumption amount (e.g., not more than 20%).

Using FIG. 17, a specific example of control in this embodiment will be described. Also in this embodiment, a flowchart of FIG. 17 is executed every rising (OFF/ON) of the developing device 4, and drive is started at a screw rotational speed acquired therefrom. That is, also in this embodiment, a change timing of the screw rotational speed is timing of developing driving OFF/ON.

First, every developing drive OFF/ON, an image formation sheet number (print number) C(n) at that time is read from the memory 51, and is compared with a print number Ch in which the last developer humidity H in the memory 51 is renewed (S21). Then, when C(n)−Ch is not less than 300 sheets (Y of S21), the developer humidity at that time is read from the memory 51, and is set at a developer humidity H used for screw rotational speed control (S2). The developer humidity is calculated every printing and is stored in the memory 51. Thereafter, a print number C(n) at that time is used as a sheet number Ch in which the developer humidity H is renewed most recently (S23), and the sequence goes to subsequent S24. On the other hand, in S21, when C(n)−Ch is less than 300 sheets (N of S21), the developer humidity H is not renewed, and the last developer humidity H is maintained as it is, so that the sequence goes to the subsequent S24.

Next, the print number C(n) read from the memory 51 is compared with a print number Cd in which the average image DUTY in the memory 51 is renewed (S24). When C(n)−Ch is not less than 1000 sheets (Y of S24), an integrated image dot number B, at that time, acquired separately by calculation is read from the memory 51. Then, by dividing the image dot number B by b_max(C(n)−Cd), the last average image DUTY is renewed and then an average image DUTY <D> per printing of one sheet until that time is acquired (S25).

The average image DUTY <D> acquired in S25 is stored in the memory 51 (S26), and the integrated dot number B is cleared to zero for calculation of a subsequent average image DUTY (S27). C(n) at that time is set at the most recent sheet number Cd in which the average image DUTY is renewed (S28), and the developing drive is actuated using the developer humidity and the average image DUTY <D> which are stored in the memory 51 (S29). That is, the screw rotational speed at the developer humidity and the average image DUTY <D> is read from the table of Table 3, and the drive of the developing device is actuated at the screw rotational speed.

On the other hand, in S25, when C(n)−Cd is less than 1000 sheets (N of S24), the average image DUTY <D> is not renewed, and the last average image DUTY <D> is maintained as it is, and the sequence goes to S29. By effecting the sequence as described above, the screw rotational speed is renewed at a certain frequency (300 sheets or more or 1000 sheets or more in this embodiment), so that the screw rotational speed corresponding to the developer humidity and the average image DUTY at that time can be set. In the case of this embodiment as described above, the screw rotational speed is controlled using the developer humidity and the average image DUTY, and therefore the developer discharge can be made with high accuracy.

An effect of this embodiment as described above will be described using FIG. 11 and FIG. 18. FIGS. 11, 18 show results of an experiment conducted for confirming the effect of this embodiment. The experiment was conducted under the following condition for each of a comparison example in which the screw rotational speed is made constant irrespective of the average image DUTY and the average image DUTY and Embodiment 3 in which the screw rotational speed is changed depending on the average image DUTY and the average image DUTY as in this embodiment. First, an image DUTY (image duty) was changed to a plurality of levels, and the developing device was driven in each of environments different in developer humidity and developer amounts in the developing containers were compared. FIGS. 11, 18 show the developer amounts, and FIG. 11 shows a result of the comparison example and FIG. 18 shows a result of Embodiment 3. In the comparison example, the screw rotational speed was constant and was 700 (rpm). Further, in Embodiment 3, the screw rotational speed was controlled using the table 2 of Table 3.

Figure 18:
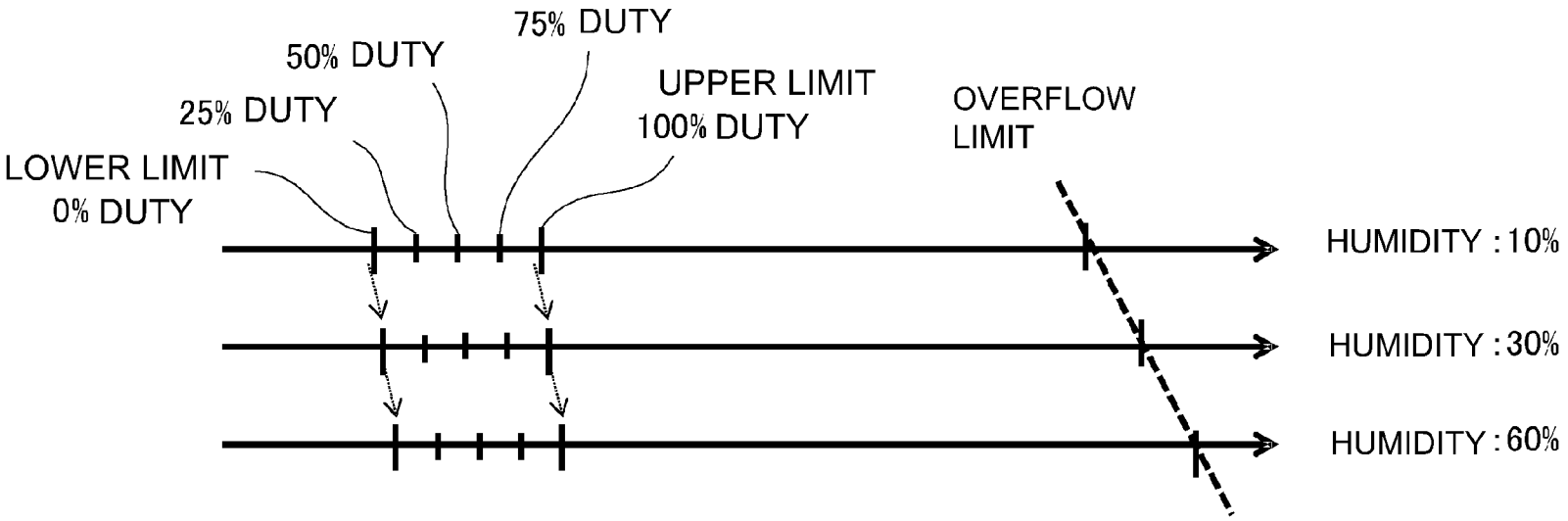
FIG. 18 is a diagram showing a change in developer amount in a developing container relative to a developer humidity at each image DUTY in Embodiment 3 of the present invention.

As shown in FIG. 18, in Embodiment 3, the screw rotational speed was controlled depending on two parameters consisting of the developer humidity and the average image DUTY, and therefore a variation in discharge amount could be suppressed more effectively even when compared with the cases of Embodiment 1 and Embodiment 2. As a result of this, it is understood that the robustness is improved against the developer overflow.

Fourth Embodiment

Figure 20:
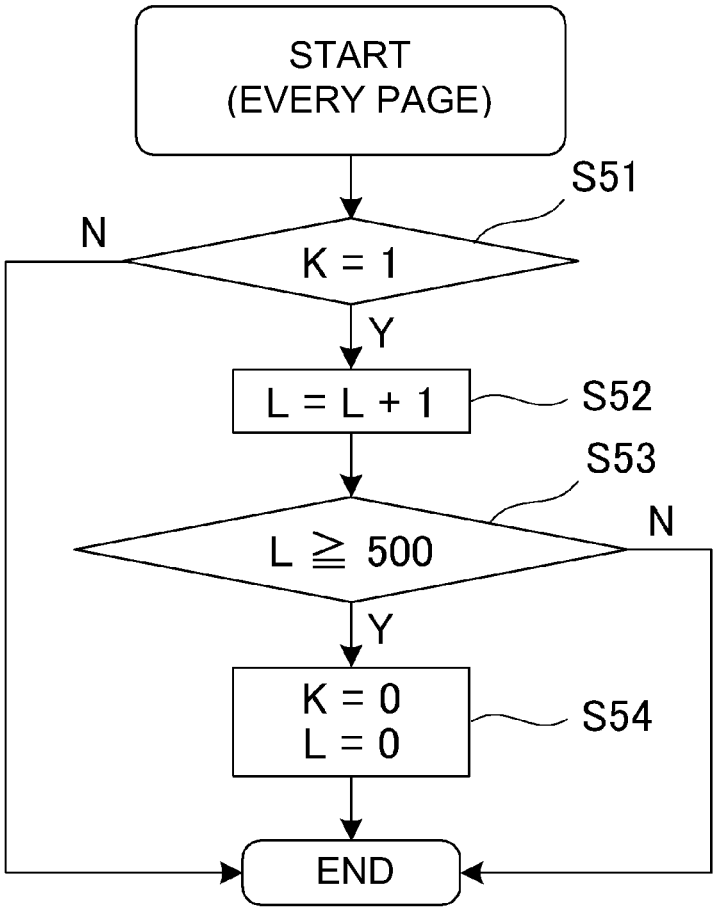
FIG. 20 is a flowchart showing another flow in the case where K=1 in a flow of FIG. 19.

The Fourth Embodiment of the present invention will be described using FIGS. 18 and 20. In the above-described Third Embodiment, by controlling the screw rotational speed depending on both of the developer humidity and the average image DUTY, the discharging characteristic of the developer at a low charge amount was promoted, so that the robustness against the developer overflow was improved. However, when an ambient temperature and an ambient humidity of the developer abruptly change, the developer humidity cannot follow the change immediately, and is gradually adapted to an ambient environment of the developer while delaying to some extent. For this reason, for some time from generation of the change in ambient temperature and humidity of the developer, the case where non-coincidence generates between an original developer state (charge amount) and a developer state (charge amount) detected and determined as described above would be considered. Therefore, in this embodiment, even in the case where the non-coincidence as described above generates, the change in screw rotational speed is not made immediately for a certain period, so that an influence thereof is made small. Other constitutions and actions are similar to those in the above-described Third Embodiment, and therefore redundant illustration and description will be omitted or briefly made, and to the same constituent elements, the same reference symbols are added, and in the following, a portion different from the Third Embodiment will be principally described.

Thus, also in this embodiment, similarly as in the Third Embodiment, as the information on the developer charge amount, the developer humidity and the image DUTY is used. For this purpose, also the image forming apparatus in this embodiment includes, as shown in FIG. 16, the CPU 50, the memory 51, the counter 52 and the video counting portion 57. Also in this embodiment, the counter 52 and the video counting portion 57 constitute the toner consumption amount detecting portion 58 as an acquiring portion and a toner consumption amount detecting means. Structures and actions of the respective portions are similar to those in the First and Second Embodiments.

Also in the case of this embodiment, the CPU 50 controls the screw rotational speed on the basis of the developer humidity and the average image DUTY which are stored in the memory 51. However, in the case where the humidity detected by the humidity detecting portion 53 at predetermined timing (during the developing drive OFF/ON in this embodiment) changes largely relative to the humidity stored in the memory 51, the information on the developer humidity is not renewed for a while. That is, the case where a currently detected humidity (humidity information) changes, relative to the previously detected humidity (humidity information), from a low-humidity section which is (corresponds to) a predetermined humidity range to a high-humidity section which is (corresponds to) a humidity range higher in humidity than the low-humidity section will be considered. In this case, the humidity stored in the memory 51 is not renewed from the time of the change until the image is formed on a predetermined number of sheets of the recording material. That is, the screw rotational speed is controlled using the humidity kept at the last value. On the other hand, in the case other than that case, similarly as in the Third Embodiment, the humidity stored in the memory 51 is renewed to a humidity detected at that time, and the screw rotational speed is controlled using the (renewed) humidity.

In other words, when an ambient environment of the developer changes in developer humidity from the low-humidity section to the high-humidity section, the screw rotational speed is not changed immediately, but is kept as it is until the printing of a predetermined sheet number (500 sheets in this embodiment). Thereafter, the screw rotational speed is changed depending on the detected humidity during the developing drive OFF/ON mode first after the sheet number exceeds 500 sheets.

Incidentally, the humidity section in this embodiment includes sections shown in the above-described Table 3, in which the humidity section is divided into three sections. That is, a first section is "15% or less", a second section is more than 15% and 45% or less", and a third section is more than 45%". Accordingly, the case where the currently detected humidity changes, relative to the previously detected humidity, from the low-humidity section which is the predetermined humidity range to the high-humidity section which is the humidity range higher in humidity than the low-humidity section is the following case. That is, the case is the case where the previously detected humidity is in a range of the first section and the currently detected humidity is in a range of the second section or the third section, or the case where the previously detected humidity is in a range of the second section and the currently detected humidity is in a range of the third section. In this case, the screw rotational speed is not changed immediately, and the screw rotational speed is kept as it is until the printing of a predetermined sheet number is made.

Here, in the screw rotational speed control, in the case where if the developer humidity determined by detection with the temperature sensor or the water content sensor and an actual developer humidity are not matched with each other, the case liable to have a most harmful effect is as follows. That is, the case is the case where although the developer has the humidity which is not so high, the humidity detected and determined is a high humidity and the screw is driven at a rotational speed faster than the original screw rotational speed, and the developer is discharged excessively. This is because a speed at which the developer decreases due to the excessive developer discharge is fast in general, and the developer is depleted soon and is not sufficiently supplied to the developing sleeve, so that there is an increasing possibility that an image defect such as density non-uniformity is generated.

On the other hand, the case where the improper developer discharge continues over a long term becomes serious, but a risk of overflow or the like due to the increase in developer is small in a period in which the above-described humidities are not matched temporarily. Further, in the case where the ambient environment of the developer changes from the low humidity to the high humidity, the developer follows the environment with a delay to some extent, and therefore it would be considered that a problem as described above is liable to relatively generate not a little. For the reasons as described above, in this embodiment, the screw rotational speed control depending on the developer humidity was not effected from the time of switching of the developer humidity detected by the temperature sensor or the water content sensor from the low-humidity section to the high-humidity section until the printing of 500 sheets was made.

On the other hand, the case where the humidity section is switched from the high humidity to the low humidity on the basis of the detection with the temperature sensor or the water content sensor is as follows. That is, the case in the case where even if the detected developer humidity and the actual developer humidity are not matched with each other, the humidity detected and determined is a low humidity although the developer has the humidity which is not so low. This case is the case where the screw is driven at a rotational speed slower than the original screw rotational speed and the improper developer discharge generates. As described above, the case where such a state continues over a long terms becomes serious, but the detected developer humidity and the actual developer humidity gradually coincide with each other with the drive of the screw, and therefore when the above developer humidities are not matched temporarily, a risk of overflow or the like due to the increase in developer is small. Therefore, in this case, there is no need to effect control such that the charge in screw rotational speed as during the switching from the low humidity to the high humidity is not made.

Figure 19:
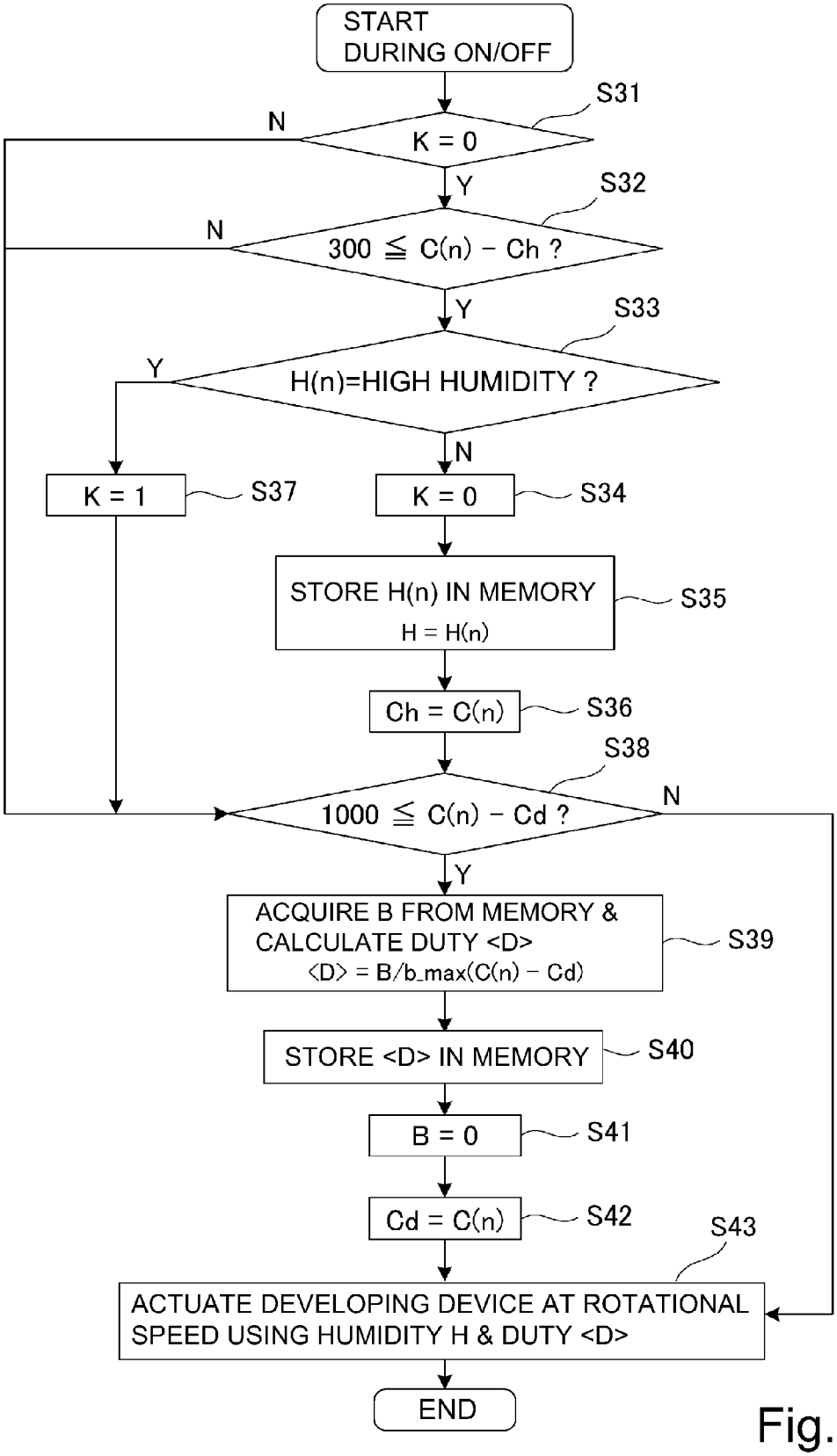
FIG. 19 is a flowchart of control during rising of a developing device in a Fourth Embodiment of the present invention.

Using FIGS. 19 and 20, a specific example of control in this embodiment will be described. Also in this embodiment, a flowchart of FIG. 19 is executed every rising (OFF/ON) of the developing device 4, and drive is started at a screw rotational speed acquired therefrom. That is, also in this embodiment, a change timing of the screw rotational speed is timing of developing driving OFF/ON. Incidentally, a flow of FIG. 19 is in common with the above-described flow of FIG. 17 at many portions, and therefore the same steps are omitted from description or briefly described, and as regards FIG. 19, a portion different from the flow of FIG. 17 will be principally described.

First, whether or not flag K=0 described later is checked every developing drive OFF/ON (S31). When K=0 (Y of S31), i.e., when the flag is not set, an image formation sheet number (print number) C(n) at that time is compared with a print number Ch in which the last screw rotational speed is changed depending on the humidity (S32). Then, whether or not a developer humidity H(n) intended to be currently renewed changes, relative to the previously renewed developer humidity H (i.e., the developer humidity H stored in the memory 51), from the low-humidity section to the high-humidity section in the table of Table 3 is discriminated (S33). If the developer humidity H is not switched from the low-humidity section to the high-humidity section (N of S33), K=0 is kept as it is (S34), and the sequence goes to S35. That is, the developer humidity at that time is read from the memory 51, and is set at a developer humidity H used for screw rotational speed control (S35). Thereafter, a print number C(n) at that time is used as a sheet number Ch in which the developer humidity H is renewed most recently (S36), and the sequence goes to subsequent S38.

In S33, the developer humidity is switched from the low-humidity section (Y of S33), a screw rotational speed maintaining flag K is set at 1 (K=1), the developer humidity H is not renewed and is kept as it is, and the sequence goes to control with the average image DUTY (S37). S38 to S43 are identical to S24 to S29 in FIG. 17, and therefore description will be omitted. Thereafter, every developing drive OFF/ON, in the first flow, whether or not K is 1 is checked (S31), and when K=1, the sequence unconditionally goes to the control with the average image DUTY, and steps of S38 and later are executed.

Here, switching of K from 0 to 1 (elimination (reset) of the flag) is made from the time when the print number reaches a print number at K=1 until the print number is counted as 500 sheets. This flow is shown in FIG. 20. That is, at the time of start of printing (not at the time of start of a print job), whether or not K=1 is checked (S51). Then, when K=1 (Y of S51), a print number L is counted (S52), and at the time when L is 500 sheets or more (Y of S53), K=0 and L=0 are set (S54). By this, from the time of K=1, printing of 500 sheets or more is made and the flag is eliminated (reset), so that the sequence is capable of going to the steps of S32 and later in FIG. 19.

For example, in the table 3 of Table 3, the case where the section of the screw rotational speed is changed from a section (900 rpm) of "humidity: 15%-45%, average image DUTY: 20%-50%" to a higher humidity section (e.g., humidity: 60%) will be described. In this case, K=1 and the developer humidity H is not renewed, but if also the image DUTY becomes a high DUTY at the same time and exceeds 50%, the section of the screw rotational speed is a section of "humidity: 15%-45%, average image DUTY: 50% or more". Then, the screw rotational speed charges from 900 rpm to 1100 rpm. Thereafter, the printing of 500 sheets is made, and at the time of K=0, the humidity is 60%, and therefore the section of the screw rotational speed is "humidity: 45% or more, average image DUTY: 50% or more", so that the screw rotational speed is changed from 1100 rpm to 1400 rpm.

In the case of this embodiment, by effecting the control as described above, while reducing the risk such that the humidities in different environment are not matched as described above, it becomes possible to select an optimum screw rotational speed depending on the environment and the image DUTY of the print image. As a result of this, an image defect such as the developer overflow is suppressed, so that it is possible to obtain a stable image for a long term.

Other Embodiments

In the above-described embodiments, the image formation sheet number is counted for making the renewal of the developer humidity H and the average image DUTY <D> and for eliminating (resetting) the flag K, but this may also be replaced with a driving time of the developing sleeve. Further, the driving sources of the developing sleeve and the feeding screws are separately provided, but the same driving source may also be used.

Figure 21:
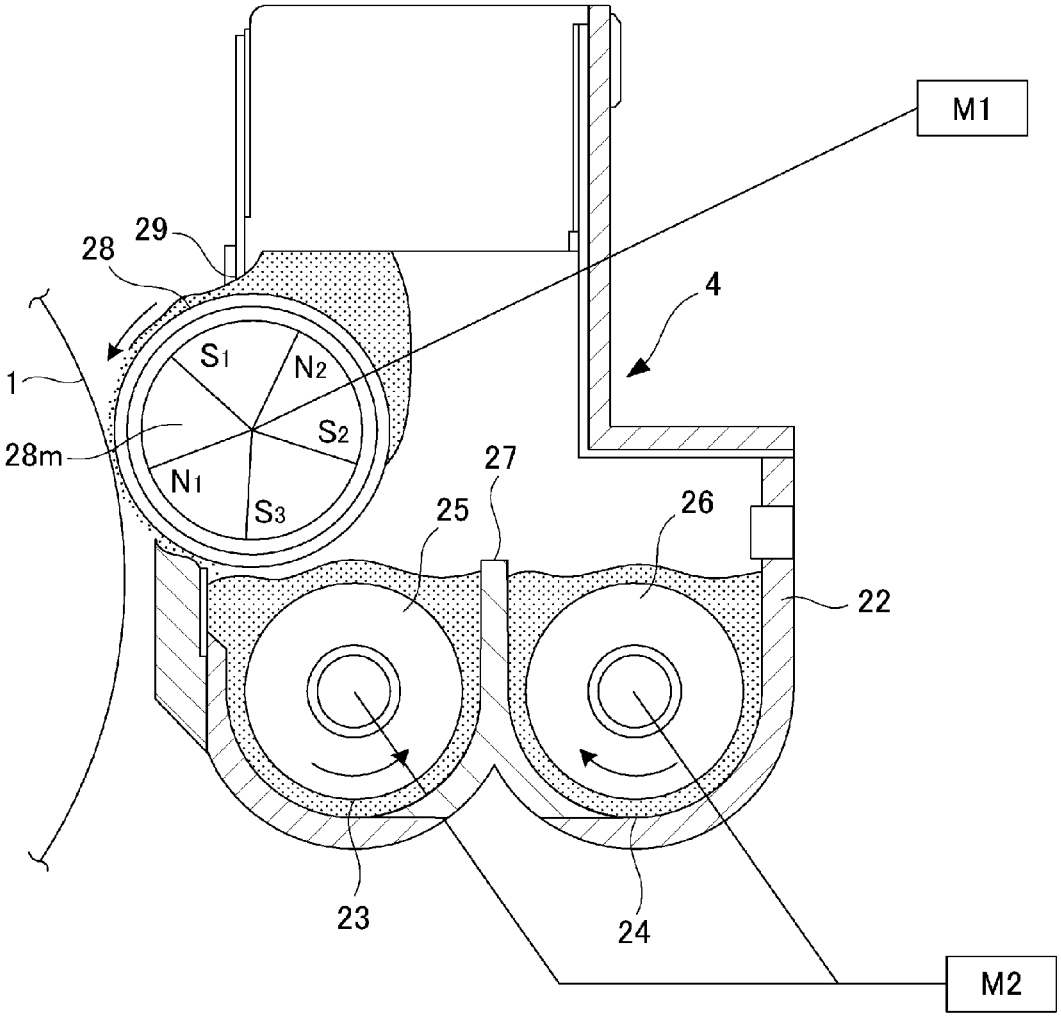
FIG. 21 is a schematic cross-sectional structural view of a developing device in a first example in other embodiments of the present invention.
Figure 22:
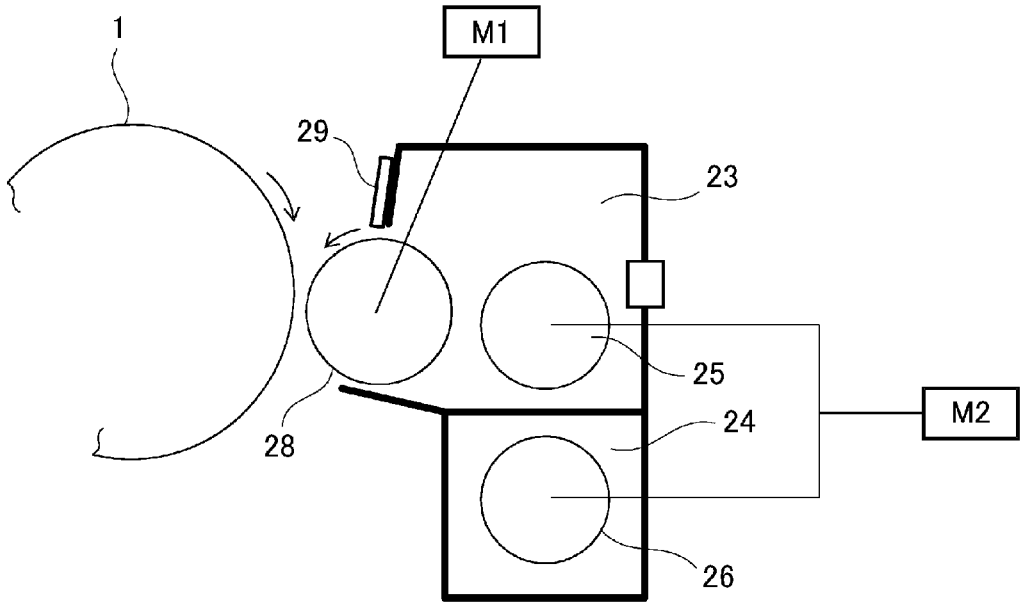
FIG. 22 is a schematic cross-sectional structural view of a developing device in a second example in other embodiments of the present invention.

Further, in the above-described embodiments, the developing device of a vertical stirring type in which the developing chamber 23 having a function of supplying the developer to the developing sleeve 23 and the stirring chamber 24 having a function of collecting the developer from the developing sleeve 28 are vertically disposed separately was used. However, the present invention is also applicable to an image forming apparatus including a developing device having a constitution other than such a constitution. For example, as shown in FIG. 21, when the driving source of the developing sleeve 28 and the driving source of the feeding screws 25, 26 are provided separately from each other, it is also possible to use a developing device of a horizontal stirring type in which the developing chamber 23 and the stirring chamber 24 are horizontally disposed. Further, as shown in FIG. 22, even in the vertical stirring type, when the driving sources of the developing sleeve 28 and the feeding screws 25, 26 are provided separately from each other, it is also possible to use a developing device in which the function of supplying the developer to the developing sleeve 28 and the function of collecting the developer after being used for developing the latent image are not separated from each other.

INDUSTRIAL APPLICABILITY

According to the present invention, even when the flowability of the developer is high and the developer does not readily stagnate in the neighborhood of the discharge opening, an image forming apparatus capable of properly making the discharge of the developer by raising the developer surface is provided.

EXPLANATION OF SYMBOLS

1 (1*a*, 1*b*, 1*c*, 1*d*) . . . photosensitive drum (image bearing member)/4 (4*a*, 4*b*, 4*c*, 4*d*) . . . developing device (developing means)/22 . . . developing container/25 . . . first feeding screw/25*a* . . . rotation shaft/25*b* . . . blade/26 . . . second feeding screw/31 . . . hopper (supplying means)/32 . . . supplying screw/40 . . . discharge opening/50 . . . CPU (controller)/51 . . . memory (storing means)/52 . . . counter/53 . . . humidity detecting portion (acquiring portion, humidity detecting portion/54 . . . water content sensor (water content detecting means)/55 . . . temperature sensor (temperature detecting means)/56 . . . calculating portion (calculating means)/57 . . . video count portion/58 . . . toner consumption amount detecting portion (acquiring portion, toner consumption amount detecting means)/100 . . . image forming apparatus/M1 . . . first driving motor/M2 . . . second driving motor (driving means)/α . . . first region/β . . . second region

The invention claimed is:

1. An image forming apparatus capable of continuously carrying out image formation on a plurality of recording materials, comprising:

an image bearing member;

a developing device configured to develop an electrostatic latent image, formed on said image bearing member, with a developer containing toner and a carrier, wherein said developing device includes;

a developing container capable of accommodating the developer and including a first chamber and a second chamber partitioned from said first chamber by a partition wall;

a first communication portion configured to permit communication of the developer from said first chamber to said second chamber;

a second communication portion configured to permit communication of the developer from said second chamber to said first chamber, the developer being circulatable between said first and second chambers through said first and second communication portions;

a first feeding screw provided in said second chamber and configured to feed the developer in said second chamber in a second direction opposite to a first feeding direction, the second direction being a direction in which the developer in said second chamber is fed from said second communication portion toward said first communication portion;

a second feeding screw provided in said first chamber and configured to feed the developer in said first chamber in the first feeding direction, the first direction being a direction in which the developer in said first chamber is fed from said first communication portion toward said second communication portion;

a developer supplying portion configured to supply the developer into said developing container;

a developer discharge portion provided in a side wall of said first chamber, upstream of said first communication portion and downstream of said second communication portion with respect to the first feeding direction and configured to permit discharge of a part of the developer with supply of the developer by said developer supplying portion:

a driving device configured to rotationally drive said first feeding screw; and a controller configured to control said driving device, wherein said controller includes, a first acquiring portion configured to acquire information on a relative humidity in said developing container, and a second acquiring portion configured to acquire information on an amount of toner consumed with the image formation on the plurality of recording materials, wherein said first feeding screw includes a first screw portion, a second screw portion and a third screw portion, said first screw portion being provided in a region opposing said developer discharge portion while extending along the first feeding direction, said second screw portion being provided upstream of said developer discharge portion and downstream of said second communication portion with respect to the first feeding direction, said third screw portion being provided downstream of said developer discharge portion and upstream of said first communication portion with respect to the first feeding direction, each of said second screw portion and said third screw portion being provided with a blade portion formed helically on an outer peripheral surface of a rotation shaft of said first feeding screw, and said first screw portion being not provided with said blade portion, and wherein on the basis of information on the relative humidity in said developing container, acquired by said first acquiring portion, and information on the amount of toner consumed with the image formation on the plurality of recording materials, acquired by said second acquiring portion, said controller controls a driving speed for rotationally driving said first feeding screw by said driving device.

2. An image forming apparatus according to claim 1, wherein said controller controls the driving speed, for rotationally driving said first feeding screw by said driving device, so that the driving speed is a first driving speed when the amount of toner consumed with the image formation on the plurality of recording materials is a predetermined consumption amount and the relative humidity in said developing container is a first value, and the driving speed, when the amount of toner consumed with the image formation on the plurality of recording materials is the predetermined consumption amount and the relative humidity in said developing container is a second value higher than first value, is a second driving speed faster than the first driving speed.

3. An image forming apparatus according to claim 1, wherein said controller controls the driving speed for rotationally driving said first feeding screw by said driving device, so that the driving speed is a first driving speed when the relative humidity in said developing container is a predetermined value and the amount of toner consumed with the image formation on the plurality of recording materials is a first consumption amount, and the driving speed, when the relative humidity in said developing container is the predetermined value and the amount of toner consumed with the image formation on the plurality of recording materials is a second consumption amount more than the first consumption amount, is a second driving speed faster than the first driving speed.

4. An image forming apparatus according to claim 1, wherein said controller controls the driving speed for rotationally driving said first feeding screw by said driving device, so that the driving speed is a first driving speed when the amount of toner consumed with the image formation on the plurality of recording materials is a first consumption amount and the relative humidity in said developing container is a first value, and the driving speed, when the amount of the toner consumed with the image formation on the plurality of recording materials is the first consumption amount and the relative humidity in said developing container is a second value higher than first value, is a second driving speed faster than the first driving speed, and wherein said controller controls the driving speed for rotationally driving said first feeding screw by said driving device, so that the driving speed is the second driving speed when the amount of toner consumed with the image formation on the plurality of recording materials is the first consumption amount and the relative humidity in said developing container is the second value, and the driving speed, when the amount of the toner consumed with the image formation on the plurality of recording materials is a second consumption amount more than the first consumption amount and the relative humidity in said developing container is the second value, is a third driving speed faster than the first driving speed.

5. An image forming apparatus according to claim 1, wherein said controller controls the driving speed for rotationally driving said first feeding screw by said driving device, so that the driving speed is a first driving speed when the relative humidity in said developing container is a first value and the amount of toner consumed with the image formation on the plurality of recording materials is a first consumption amount, and the driving speed when the relative humidity in said developing container is the first value and the amount of toner consumed with the image formation on the plurality of recording materials is a second consumption amount more than the first consumption amount, is a second driving speed faster than the first driving speed, and wherein said controller controls the driving speed for rotationally driving said first feeding screw by said driving device, so that the driving speed is the second driving speed when the relative humidity in said developing container is the first value and the amount of toner consumed with the image formation on the plurality of recording materials is the second consumption amount, and the driving speed when the relative humidity in said developing container is a second value higher than the first value and the amount of the toner consumed with the image formation on the plurality of recording materials is the second consumption amount, is a third driving speed faster than the first driving speed.

6. An image forming apparatus according to claim 1, wherein when rotational drive of said first feeding screw is started in a state that rotational drive of said first feeding screw is at rest, said controller controls the driving speed for rotationally driving said first feeding screw by said driving device.

7. An image forming apparatus according to claim 1, wherein the information on the amount of toner consumed with the image formation on the plurality of recording materials is an average image duty in the image formation on the plurality of recording materials carried out in a period from control, by said controller, of the driving speed for rotationally driving said first feeding screw by said driving device to subsequent control, by said controller, of the driving speed for rotationally driving said first feeding screw by said driving device.

8. An image forming apparatus according to claim 1, wherein said first acquiring portion further acquires information on a temperature in said developing container, and wherein on the basis of information on the relative humidity in said developing container and on the temperature in said developing container, acquired by said first acquiring portion, and the information on the amount of the toner consumed with the image formation on the plurality of recording materials, acquired by said second acquiring portion, said controller controls the driving speed for rotationally driving said first feeding screw by said driving device.

9. An image forming apparatus according to claim 1, wherein said developing device further includes a developer carrying member configured to feed the developer to a developing region opposing said image bearing member while carrying the developer, and wherein said first feeding screw feeds the developer in said first chamber to said developer carrying member.

10. An image forming apparatus capable of continuously carrying out image formation on a plurality of recording materials, comprising:

an image bearing member;

a developing device configured to develop an electrostatic latent image, formed on said image bearing member, with a developer containing toner and a carrier, wherein said developing device includes;

a developing container capable of accommodating the developer and including a first chamber and a second chamber partitioned from said first chamber by a partition wall;

a first communication portion configured to permit communication of the developer from said first chamber to said second chamber;

a second communication portion configured to permit communication of the developer from said second chamber to said first chamber, the developer being circulatable between said first and second chambers through said first and second communication portions;

a first feeding screw provided in said second chamber and configured to feed the developer in said second chamber in a second direction opposite to a first feeding direction, the second direction being a direction in which the developer in said second chamber is fed from said second communication portion toward said first communication portion;

a second feeding screw provided in said first chamber and configured to feed the developer in said first chamber in the first feeding direction, the first direction being a direction in which the developer in said first chamber is fed from said first communication portion toward said second communication portion;

a developer supplying portion configured to supply the developer into said developing container;

a developer discharge portion provided in a side wall of said first chamber, upstream of said first communication portion and downstream of said second communication portion with respect to the first feeding direction and configured to permit discharge of a part of the developer with supply of the developer by said developer supplying portion:

a driving device configured to rotationally drive said first feeding screw; and a controller configured to control said driving device, wherein said controller includes, a first acquiring portion configured to acquire information on a relative humidity in said developing container, and a second acquiring portion configured to acquire information on an amount of the toner consumed with the image formation on the plurality of recording materials, wherein said first feeding screw includes a first screw portion, a second screw portion and a third screw portion, said first screw portion being provided in a region opposing said developer discharge portion while extending along the first feeding direction, said second screw portion being provided upstream of said developer discharge portion and downstream of said second communication portion with respect to the first feeding direction, said third screw portion being provided downstream of said developer discharge portion and upstream of said first communication portion with respect to the first feeding direction, and with respect to a blade portion formed helically on an outer peripheral surface of a rotation shaft of said first feeding screw, an outer diameter of the blade portion of said first screw portion being smaller than each of said second screw portion and said third screw portion, and wherein on the basis of information on the relative humidity in said developing container, acquired by said first acquiring portion, and information on the amount of toner consumed with the image formation on the plurality of recording materials, acquired by said second acquiring portion, said controller controls a driving speed for rotationally driving said first feeding screw by said driving device.

11. An image forming apparatus according to claim 10, wherein said controller controls the driving speed for rotationally driving said first feeding screw by said driving device, so that the driving speed is a first driving speed when the amount of toner consumed with the image formation on the plurality of recording materials is a predetermined consumption amount and the relative humidity in said developing container is a first value, and the driving speed when the amount of toner consumed with the image formation on the plurality of recording materials is the predetermined consumption amount and the relative humidity in said developing container is a second value higher than first value is a second driving speed faster than the first driving speed.

12. An image forming apparatus according to claim 10, wherein said controller controls the driving speed for rotationally driving said first feeding screw by said driving device, so that the driving speed is a first driving speed when the relative humidity in said developing container is a predetermined value and the amount of toner consumed with the image formation on the plurality of recording materials is a first consumption amount, and the driving speed when the relative humidity in said developing container is the predetermined value and the amount of toner consumed with the image formation on the plurality of recording materials is a second consumption amount more than the first consumption amount is a second driving speed faster than the first driving speed.

13. An image forming apparatus according to claim 10, wherein said controller controls the driving speed for rotationally driving said first feeding screw by said driving device, so that the driving speed is a first driving speed when the amount of toner consumed with the image formation on the plurality of recording materials is a first consumption amount and the relative humidity in said developing container is a first value, and the driving speed when the amount of toner consumed with the image formation on the plurality of recording materials is the first consumption amount and the relative humidity in said developing container is a second value higher than first value is a second driving speed faster than the first driving speed, and wherein said controller controls the driving speed, for rotationally driving said first feeding screw by said driving device so that than the driving speed is the second driving speed when the amount of toner consumed with the image formation on the plurality of recording materials is the first consumption amount and the relative humidity in said developing container is the second value, and the driving speed when the amount of toner consumed with the image formation on the plurality of recording materials is a second consumption amount more than the first consumption amount and the relative humidity in said developing container is the second value is a third driving speed faster than the first driving speed.

14. An image forming apparatus according to claim 10, wherein said controller controls the driving speed for rotationally driving said first feeding screw by said driving device, so that the driving speed is a first driving speed when the relative humidity in said developing container is a first value and the amount of toner consumed with the image formation on the plurality of recording materials is a first consumption amount, and the driving speed when the relative humidity in said developing container is the first value and the amount of toner consumed with the image formation on the plurality of recording materials is a second consumption amount more than the first consumption amount is a second driving speed faster than the first driving speed, and wherein said controller controls the driving speed for rotationally driving said first feeding screw by said driving device, so that than the driving speed is the second driving speed when the relative humidity in said developing container is the first value and the amount of toner consumed with the image formation on the plurality of recording materials is the second consumption amount, and the driving speed when the relative humidity in said developing container is a second value higher than the first value and the amount of toner consumed with the image formation on the plurality of recording materials is the second consumption amount is a third driving speed faster than the first driving speed.

15. An image forming apparatus according to claim 10, wherein when rotational drive of said first feeding screw is started in a state that rotational drive of said first feeding screw is at rest, said controller controls the driving speed for rotationally driving said first feeding screw by said driving device.

16. An image forming apparatus according to claim 10, wherein the information on the amount of toner consumed with the image formation on the plurality of recording materials is an average image duty in the image formation on the plurality of recording materials carried out in a period from control, by said controller, of the driving speed for rotationally driving said first feeding screw by said driving device to subsequent control, by said controller, of the driving speed for rotationally driving said first feeding screw by said driving device.

17. An image forming apparatus according to claim 10, wherein said first acquiring portion further acquires information on a temperature in said developing container, and wherein on the basis of the information on the relative humidity in said developing container and on the temperature in said developing container, acquired by said first acquiring portion, and the information on the amount of toner consumed with the image formation on the plurality of recording materials, acquired by said second acquiring portion, said controller controls the driving speed for rotationally driving said first feeding screw by said driving device.

18. An image forming apparatus according to claim 10, wherein said developing device further includes a developer carrying member configured to feed the developer to a developing region opposing said image bearing member while carrying the developer, and wherein said first feeding screw feeds the developer in said first chamber to said developer carrying member.

* * * * *